US007803726B2

(12) United States Patent
Policicchio et al.

(10) Patent No.: US 7,803,726 B2
(45) Date of Patent: Sep. 28, 2010

(54) DUSTER SYSTEM FOR DAMP AND DRY DUSTING

(75) Inventors: Nicola John Policicchio, Mason, OH (US); Alan Edward Sherry, Newport, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 316 days.

(21) Appl. No.: 11/500,229

(22) Filed: Aug. 7, 2006

(65) Prior Publication Data

US 2008/0032577 A1 Feb. 7, 2008

(51) Int. Cl.
*B32B 27/04* (2006.01)
*B32B 5/24* (2006.01)
*A47K 7/02* (2006.01)

(52) U.S. Cl. ..... 442/123; 442/373; 15/229.2

(58) Field of Classification Search ..... 442/123, 442/373

See application file for complete search history.

(56) References Cited

U.S. PATENT DOCUMENTS

| | | | | |
|---|---|---|---|---|
| 4,869,934 | A | 2/1989 | Jethwa | |
| 4,810,407 | A | 3/1989 | Sandvick | |
| 5,085,695 | A | 2/1992 | Randen et al. | |
| 5,112,394 | A | 5/1992 | Miller | |
| 5,397,384 | A | 3/1995 | Wisniewski | |
| 6,652,632 | B2 | 11/2003 | Moodycliffe et al. | |
| 6,930,080 | B2 | 8/2005 | Moodycliffe et al. | |
| 2005/0096239 | A1 | 5/2005 | Barnabas et al. | |
| 2005/0215459 | A1 * | 9/2005 | Policicchio et al. | 510/438 |
| 2006/0171764 | A1 | 8/2006 | Hoadley | |

* cited by examiner

*Primary Examiner*—Lynda Salvatore
(74) *Attorney, Agent, or Firm*—Larry L. Huston; Leonard W. Lewis; Steven W. Miller

(57) ABSTRACT

A kit duster pad and a cleaning composition said duster pad comprising at least one layer comprising hydrophilic non-woven fibers capable of contacting a surface to be cleaned; and at least one non-woven layer capable of being attached to a handle, wherein the at least one layer comprises at least one free end; and wherein said cleaning composition comprises a solids content at least about 0.5% by weight of the cleaning composition.

34 Claims, 16 Drawing Sheets

DUSTER SYSTEM FOR DAMP AND DRY DUSTING

BACKGROUND OF THE INVENTION

Many cleaning articles have been created for dusting. Rags or paper towels used dry or wet with polishing and furniture polishing compositions have been used on relatively flat surfaces; however, they are less effective when cleaning cracks and crevices. To overcome the problems associated with rags and paper towels, dust gathering devices have been created using feathers, lamb's wool, and synthetic fibers brushes. These dust gathering devices can be expensive to manufacture, and as such are designed to be re-usable. Soiled traditional dusters are typically cleaned via shaking the dust gathering device. An inherent problem associated with dusting with a dust gathering device is that dust gathering devices do not hold on or trap dust very well. As such, soils trapped by dust gathering devices are prone to redeposit dust, often during use, which can be frustrating to consumers.

To address the problems experienced with dust gathering devices, disposable dust gathering devices have been developed which have limited re-usability. These disposable dust gathering devices may include brush portions made of synthetic fiber bundles attached to a non-woven. While these disposable dust gathering devices may be useful for dusting, when used in combination with polishing and furniture polishing compositions the disposable dusters are rendered ineffective, as these dust gathering devices become matted down or ball up. Additionally, these dusters are not effective at polishing and enhancing surface shine relative to rags or paper towels used in combination with polishing and furniture polishing compositions. By contrast, the rags and paper towels do not provide all the benefits delivered by a disposable dry a duster attached to a handle including 1) hygiene (hand does not touch chemicals, dirt or surface during cleaning), 2) reach (can get into cracks and crevices and hard to reach places such as behind electronics, not easy or possible when using rags and paper towels by hand), and 3) convenience (can dust and clean between knick knacks without having to move them).

The S.C. Johnson company introduced a disposable dust gathering device used in combination with a spray solution. This system is prone to leaving behind a visually noticeable residue. This residue creates an unacceptable hazy appearance on glass and shiny surfaces. On wood surfaces, the shine is often uneven and splotchy due to inability of the duster to evenly spread the solution across the entire surface. A significant deficiency of the Pledge system is that it is constructed of 100% thermoplastic synthetic materials. Instrumental analysis using Infrared and Light microscopy indicate that the materials making up the Pledge duster are bicomponent thermoplastic synthetic fibers of polyethylene and polyester. This includes the attachment layer non-wovens and fibrous tow material making up the cleaning layers. While synthetic non-wovens and synthetic fibrous materials such as tow fibers have characteristics that make them effective for dry dusting, they are not optimized for polishing or wood polishing. Thermoplastic synthetic fibers such as polyethylene and polyester have a low affinity for water or aqueous solutions and poor water absorbency. Furthermore, the water or aqueous solution that is adsorbed between the fibers is only loosely bound and is therefore easily dumped back onto the surface. As a result, dusters composed of synthetic fibers do not evenly or effectively spread liquid when wiped across a surface.

While attempts to improve the cleaning characteristics of dust gathering devices have been made, there has to date been no dust gathering device that substantially eliminates its problems and inefficiencies.

It is, therefore, highly desirable to create a duster that maximizes a user's effort while minimizing the spreading of dust particles. It is also highly desirable to create a duster that is capable of providing even polishing without any of the above user negatives. Further, it is highly desirable to maximize the functionality and versatility of a duster. This invention accomplishes those goals.

SUMMARY OF THE INVENTION

One aspect of the invention relates to a kit comprising a duster pad and a cleaning composition said duster pad comprising at least one layer comprising hydrophilic non-woven fibers capable of contacting a surface to be cleaned; and at least one non-woven layer capable of being attached to a handle, wherein the at least one layer comprises at least one free end; and wherein said cleaning composition comprises a solids content at least about 0.5% by weight of the cleaning composition.

DETAILED DESCRIPTION OF THE INVENTION

Figure 1:
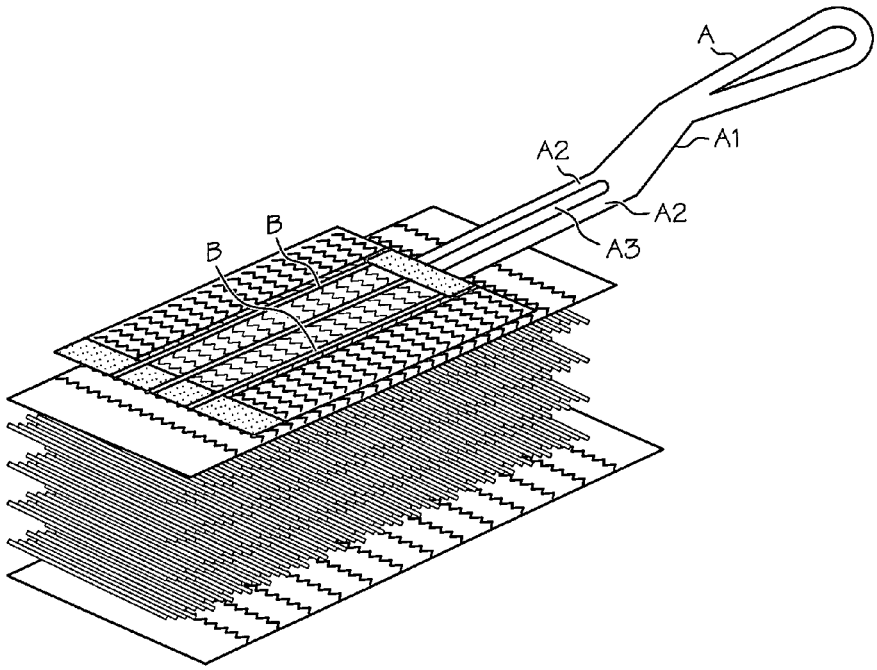
FIG. 1 illustrates a duster with a fork removably attached to a hydrophilic sheet.
Figure 2A:
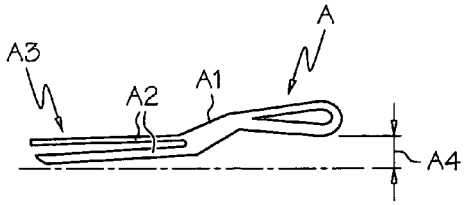
FIG. 2 illustrates a comparison between a duster having an angled handle and a duster having a flat handle.
Figure 2B:
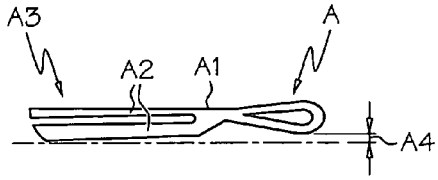
Figure 2C:
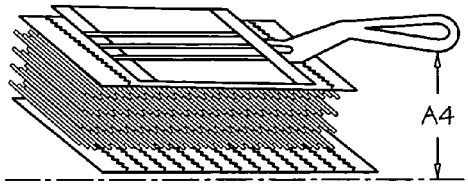
Figure 2D:
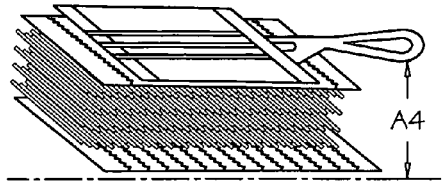

While the specification concludes with the claims particularly pointing and distinctly claiming the invention, it is believed that the present invention will be better understood from the following description.

The devices, apparatuses, methods, components, and/or compositions of the present invention can include, consist essentially of, or consist of, the components of the present invention as well as other ingredients described herein. As used herein, "consisting essentially of" means that the devices, apparatuses, methods, components, and/or compositions may include additional ingredients, but only if the additional ingredients do not materially alter the basic and novel characteristics of the claimed devices, apparatuses, methods, components, and/or compositions.

All percentages and ratios used herein are by weight of the total composition and all measurements made are at 25° C., unless otherwise designated. A degree is a planar unit of angular measure equal in magnitude to 1/360 of a complete revolution. When possible, an angle is measured between the outer edge of the inner facing surface and the vertex, whereby the outer edge is located is distally located from the vertex.

All measurements used herein are in metric units unless otherwise specified.

All ratios described herein are on a weight by weight basis unless otherwise specified.

As used herein "limited re-usability" means that that the substrate is used for one job (one job equaling cleaning about 100 square feet of surface), stored and re-used for about 2 to 5 more jobs (cleaning about 200 to about 500 square feet of surface), and then disposed of.

As used herein "disposable cleaning substrate" means that the substrate is typically used for cleaning and then disposed of. Such disposable cleaning substrates have limited reusability. For purposes of clarification, traditional dusters including feather dusters, cloths, string mops, strips mops and the like, are not disposable cleaning substrates for purposes of this invention.

As used herein "bundle fibers" and/or "tow" means fibers comprising thermoplastic synthetic polymers including polyester, polypropylene, polyethylene and cellulosic materials including cellulose acetate and mixtures thereof manufactured where in the individual fibers are long continuous strands manufactured in bundles. In the context of a duster where the bundle fibers are cut, the bundle fibers is defined as any fibers which have a distinct start and end point where in the distance between the start and end point is at least about 1 cm in length.

As used herein "basis weight" means the weight of a non-woven substrate or layer divided by its area. It is herein reported on as grams per square meter ($g/m^2$).

As used herein "hydrophilic", "naturally hydrophilic" and "cellulosic" refers to fibers that have a high affinity for water and/or aqueous solutions. Hydrophilic fibers include but are not limited to woody fibers such as cellulose pulp obtained from trees or produced by microbes, and non-woody fibers such as cotton, hemp, jute, abaca, kenaf, sabai grass, flax, esparto grass, straw, bagasse, milkweed floss fibers, and pineapple leaf fibers. Hydrophilic fibers can also include those that are based on naturally hydrophilic fibers but have been chemically treated such as rayon, viscose, lyocell, acetate, triacetate and the like.

As used herein "hydrophilic non-woven layer(s)" or "hydrophilic non-woven(s)" refers to a layer or layers comprising hydrophilic non-woven fibers.

As used herein "aqueous solution(s)" "dusting solution(s)" "cleaning solution(s)" means a cleaning solution whether isotropic or non-isotropic, that comprise in one embodiment a majority water, in another embodiment at least about 60%, in yet another embodiment at least about 70%, in yet another embodiment at least about 80% and in still another embodiment at least about 90% water.

As used herein "hydrophobic", "synthetic", "thermoplastic", and "naturally hydrophobic" refers to fibers are those that have a low affinity for water and aqueous solutions. Fibers which are naturally hydrophobic include polymers derived from ethylene, propylene, styrene, amides and esters, either as homologous polymers random copolymers or block copolymers.

As used herein, an 'absorbent core' is defined a hydrophilic non-woven material with a caliper at least about 0.4 mm thick at 0.1 psi weight that additionally displays an absorbency of deionized water of at least about 7 grams per gram of substrate. The "saturation hang drip" method is used to measure the absorbency of cores and other non-woven materials. A dry non-woven substrate is pre-weighed then dunked into a reservoir filled containing one liter of deionized water. The substrate is allowed to soak for one minute. It is then removed and hung from two ends in a vertical orientation with the length of the non-woven projecting below and allowed to drip freely for 3 minutes. The wet substrate is then weighed and the amount of solution absorbed determined by difference. The gram of water per gram absorbency is calculated by dividing the weight of liquid retained by the weight of the dry substrate. Cores typically have a basis weight at least about 70 $g/m^2$, in an alternate embodiment from about 75 $g/m^2$ to about 500 $g/m^2$, in an alternate embodiment from about 75 $g/m^2$ to about 300 $g/m^2$ and in an alternate embodiment from about 75 $g/m^2$ to about 250 $g/m^2$. Absorbent cores act as reservoirs for the retention of aqueous fluids and are chosen such that the density of the non-woven is at most about 0.15 $g/cm^3$, in an alternate embodiment at most about 0.125 $g/cm^3$ and in an alternate embodiment at most about 0.10 $g/cm^3$ so as to maximize fluid capacity and bulk.

As used herein "kinetic coefficient of friction" means the friction created between a substrate and a surface wiping across a given amount of de-ionized water under a pressure of about 5 $g/cm^2$ measured while the substrate is in motion.

As used herein "static coefficient of friction" means the friction created between a substrate and a surface wiping across a given amount of de-ionized water under a pressure of about 5 $g/cm^2$ measured when the substrate is at rest.

For purposes of orientation, unless otherwise specified, the z-direction of the duster is the direction perpendicular to the non-woven layer closest to the handle; the x-y plane of the duster is defined as the plane defined by the non-woven layer closest to the handle.

It has now surprisingly been discovered that the duster of the present invention provides the cleaning, polishing, and shining benefit of traditional rags and paper towels for surfaces ranging from hard surfaces wood, wood laminates, granite, and plastics to soft surfaces including leather, and upholstery. This performance is achieved by a duster comprising a handle and a duster pad, said duster pad comprising at least one hydrophilic non-woven layer, optionally at least one absorbent core and optionally at least one fiber bundle layer, in combination with a high solids cleaning solution. In one embodiment, the hydrophilic non-woven layer, optional absorbent core and/or optional fiber bundle layer, and optional cores are centrally joined forming the duster pad. In one embodiment, the hydrophilic sheet is positioned on the outer portion of the duster, directly facing the cleaning surface; the optional fiber bundle layer is positioned between the optional core layer and the hydrophilic non-woven layer. In another embodiment, the hydrophilic non-woven layers comprise a plurality of strips free to move independently from each other for improved cleaning and dust pick-up, especially in tough to reach areas. In yet another embodiment, the duster comprises hydrophilic non-woven layers partially formed into strips in combination with one or more absorbent cores.

The present invention is also capable of being used in combination with cleaning solution for polishing and enhancing the shine of surfaces. In one embodiment, the cleaning solution is pre-applied to the duster pad, creating a pre-moistened duster. In another embodiment, the cleaning solution is contained within a separate container, such as an aerosol sprayer, non-aerosol sprayer, bottle, and the like for dosing on the duster pad and/or the surface to be cleaned. The cleaning solution of the present invention comprises at least 0.5% solids by weight, in another embodiment at least 1% solids by weight, in another embodiment at least 2% solids by weight, in another embodiment at least 5% solids by weight, in another embodiment at least 10% solids by weight. In another embodiment, the cleaning solution comprises at least about 30% aqueous solvents, in another embodiment at least about 50% aqueous solvents and water or mixtures thereof by weight.

Without wishing to be bound by theory, it is believed that the improved cleaning of the present invention is a result of the physical characteristics of the duster and duster pad. The duster pads of the invention comprise at least one layer comprising hydrophilic non-woven fibers, wherein the layers are bonded in a configuration so as to provide at least one free end that moves independently. In one embodiment, free ends are achieved by partially bonding at least one layer comprising hydrophilic non-woven fibers to a second layer. In an alternate embodiment, an increased amount of free ends is created by cutting the layer comprising hydrophilic non-woven fibers into a plurality of strips. The free ends are capable of moving, thus allowing the duster to compress into a flat position and increase the ability of the duster to get into small spaces. By having one layer or in the alternative at least two layers with moving free ends, the surface area of the duster pad is increased providing better cleaning of large areas. The duster of the present invention is also capable of being "fluffed up" to be used to clean three-dimensional surfaces, irregular shaped surfaces, curved surfaces and the like. Moreover, the hydrophilic fibers of the duster pad and the optional absorbent core, unlike other dusting gathering devices, have a high capacity for absorbing and trapping water, enabling wet cleaning.

Handle:

The duster of the present invention comprises a handle. Without wishing to be bound by theory, it is believed that the handle facilitates reach and maneuverability, provides pressure to the cleaning surface to improve cleaning, and provides separation between the dust and the user's hands. Any handle that inserts into, or is used in conjunction with, the duster pad of the invention is contemplated.

In one embodiment, a handle of the present invention comprises a gripping portion, an attachment portion, and a wiping portion. The gripping portion is defined as the portion of the handle used for gripping. The attachment portion operatively connects the gripping portion and the wiping portion. The wiping portion is capable of being removably connected to the duster pad. In one embodiment, the gripping portion and wiping portion of the handle is in the same x-y plane. In an alternate embodiment, the gripping portion and wiping portion of the handle are in different x-y planes. In such an embodiment, the x-y planes formed by the length and width of the gripping portion and wiping portion intersect each other so that the angle formed from at the intersection of the x-y planes is from about 70° to about 160°.

The handle is connected to duster pad and/or any optional attachments by any means known in the art, including mechanical and chemical means. In one embodiment, hook and loop fasteners such as Velcro® hooks, are used in conjunction with a handle. In another embodiment, at least one is formed into at least one pocket along the duster pad, and the handle is inserted into the pocket.

The following are non-limiting handles provided to illustrate the duster of the present invention. One of ordinary skill in the art will recognize that alternative designs can be made with the knowledge provided herein.

An implement handle design which is used with a dry duster is described in patent filing WO 02/34101 A1 filed Oct. 25, 2001 to Tanaka et al. A representative drawing of this duster is shown in FIG. 1. The implement handle comprises a gripping portion A, transition portion A1, attachment portion A2 and wiping portion A3. In this illustration, the wiping portion is bifurcated at the root end to provide two insert plates or forks, which are flat and level, and are to be inserted into the gaps formed in the pocket B of the duster pad.

The implement described in FIG. 1 has a transition portion A1 at an angle upward away from the surface being cleaning. By contrast, the flat handle shown in FIG. 2 has a gripping portion A, an attachment portion A2 and a wiping portion A3 are all in the same plane. The flat handle design is rendered more ergonomically friendly when the number of non-woven layers is increased. This is shown by A4 which is the distance between the cleaning surface and the gripping portion A when the implement is held in a parallel position relative to the cleaning surface.

Figure 3A:
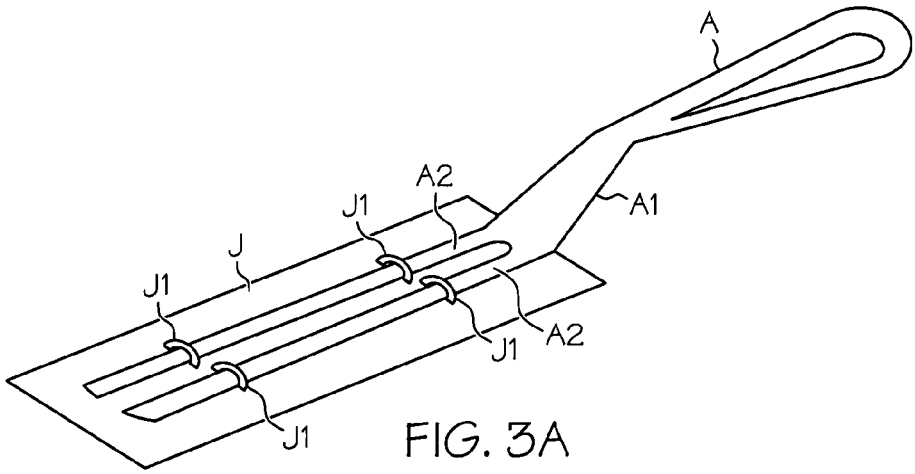
FIG. 3 illustrates a duster further comprising a wet dusting adapter.
Figure 3B:
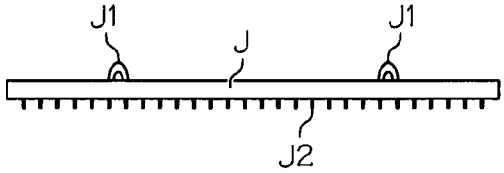

To provide increased rigidity, the handle illustrated in FIG. 3 incorporates an adapter below the wiping portion. The forks of the wiping portion A2 are attached to an adapter piece J. The forks A2 are slipped through eyelets J1 which are formed into the adapter piece J. The adapter of this embodiment re-enforces the forks A2, and widens cleaning base. Increased rigidity from the adapter improves edge cleaning for framed surfaces such as mirrors, windows, TV screens and the like. It also provides improved scrubbing and surface contact ability for z-directional cleaning of all surfaces. The adapter piece is capable of being attached and detached on the handle via any means known in the art. The detachment ability is beneficial as there are situations where users may wish to have flexible forks either for wet or dry dusting. To allow for attachment under both these situations the adapter J in one embodiment comprises an additional attachment mechanism. Any attachment means known to one of ordinary skill is contemplated. As a non-limiting example, hook and loop fasteners J2, such as Velcro®, are located on the bottom of the adapter. To ensure attachment, the material used to form the outer most portion of the duster pocket comprises of a fibrous material such as a thru-air non-woven, or comprise looped non-wovens typically used in conjunction with Velcro® hooks. In alternate embodiments loop materials that are specifically designed to engage with hooks are chosen. Non-limiting examples of suitable loop materials include the XPL series, including XPL-99139 available from 3M Corp., Series 800, 804, and 040 loops from Aplix Corp., Series 1000 and 2000 from Velcro USA Inc.

Figure 10:
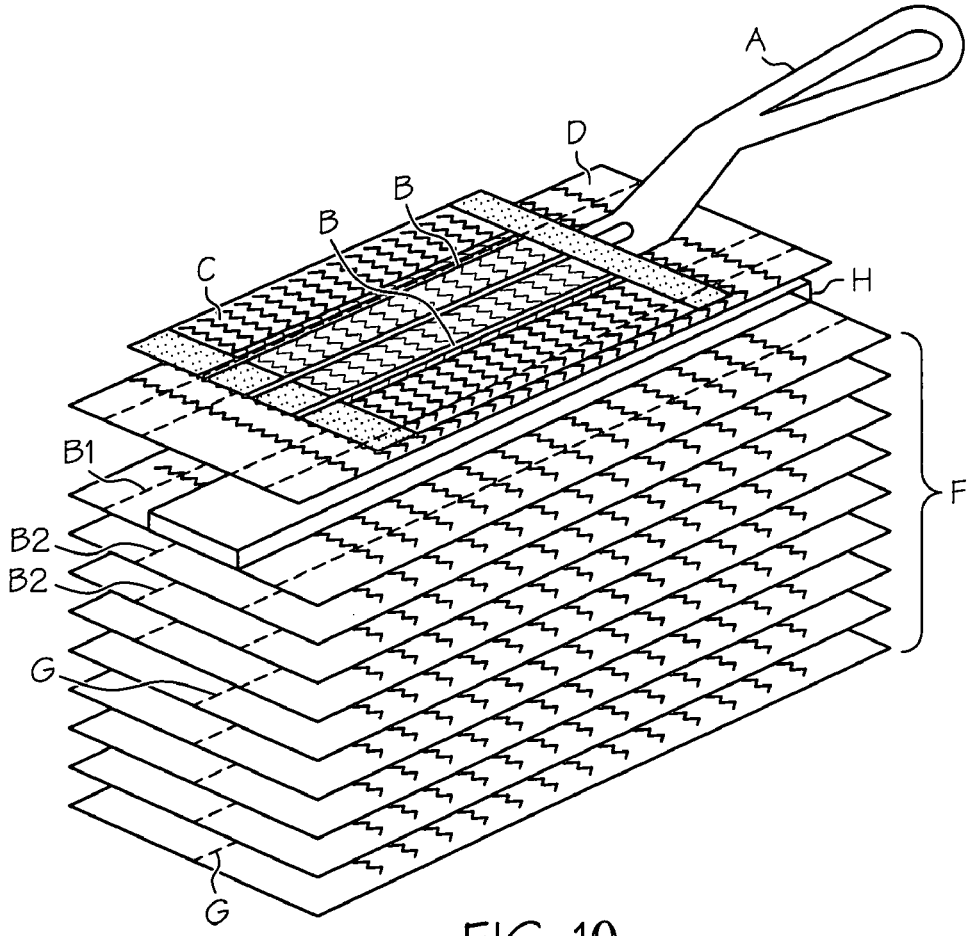
FIG. 10 illustrates a duster comprising an alternate core and non-woven.

In an alternative embodiment, the entire handle is modified by making the wiping portion of the implement wider and stiffer. The hook and loop attachment means shown in FIG. 3 as well as all other mechanical fastening systems known in the art are contemplated for use. In an alternative embodiment, grippers are incorporated on the wiping portion as shown in FIG. 10. In an alternate embodiment, the duster design includes an attachment non-woven C having a wider width than the wiping portion of the handle A. The extra width of the attachment non-woven C allows the non-woven to be wrapped around the wiping portion A3 so that it can be secured into slitted grippers J3 located above the wiping portion A3 of the implement.

Duster Pad:

While there is no limitation on the number of layers comprising hydrophilic non-woven fibers that can be added to the duster, performance and commercial considerations provide a range of from 2 to about 20 layers, in another embodiment from 3 to about 15 layers, and in another embodiment from 4 to about 12 layers. The basis weight of each hydrophilic non-woven is from about 5 to about 500 g/m$^2$, in another embodiment from about 10 to about 125 g/m$^2$, in another embodiment from about 15 to about 75 g/m$^2$, and an another embodiment from about 15 to about 50 g/m$^2$. In one embodiment, the hydrophilic non-woven is formed into a plurality of strips that are joined together. While non-wovens with high cellulosic content are contemplated, they are more difficult to consolidate into a duster using high speed manufacturing processes using heat sealing, pressure bonding or ultrasonic welding techniques. As such, other bonding methods such as gluing and sewing are used in addition to the high speed manufacturing process above. In another embodiment, to facilitate consolidation of the materials using a high speed manufacturing process, the non-woven can advantageously be constructed of a mixture of hydrophilic fibers and low melt point thermoplastic synthetic fibers such as polyethylene, polypropylene or mixtures thereof. In one embodiment, the low melt point thermoplastic material consists of bicomponent fibers wherein the inner fiber core is be a high melt point polypropylene or polyester and the outer sheath is low melt point polyethylene. In one embodiment a thermoplastic synthetic layer is composed of lower melt point materials having a lower melt point lower than about 175° C., in an alternate embodiment at most about 150° C., in an alternate embodiment at most about 130° C. Bicomponent fibers comprising an outer sheath polyethylene layer, especially when combined with the inner polypropylene core, can also advantageously be used to promote stronger bonding at faster manufacturing speeds.

In one embodiment, the hydrophilic cellulosic and low melt thermoplastic synthetic fibers are mixed homogeneously and formed into fabrics using non-woven making processes such as carded thermal bonding, thru-air bonding or spun-lacing. One process for cellulosic non-woven making can be constructed using a wet laid approach. A wet laid approach takes cellulose fibers and creates a slurry using water and chemicals. The slurry is placed on a screen mesh which allows the water to drain. As the slurry drains it forms into felts. These felts are further de-watered by running the felt through compression rolls and then dried through a drying machine especially designed for making tissue papers. The wet-laid process leads to non-wovens that are very absorbent and very low in linting which is highly advantageous in wet dusting and cleaning applications, especially on surfaces such as glass where lint is very noticeable.

An alternate means for making for improving bonding using high speed manufacturing processes is to create laminates comprising a first side that is a tissue layer and a second side that is a synthetic (or predominantly synthetic) layer. The laminate can be created by any number of means including gluing, mechanical bonding, needle punching, sewing, ultrasonic welding and the like. In one embodiment the tissue non-woven and the synthetic non-woven is consolidated using a spun-lace process. This involves feeding a preformed tissue non-woven and a preformed thermoplastic synthetic non-woven into a spun-lacing process. The high pressure water jets used in the spun-lacing process can effectively bond the tissue onto the thermoplastic synthetic layer. The high pressure from the water jest can actually force some of the fibers in the tissue layer to penetrate through the fibers in the synthetic layer. This results in a substrate that comprises cellulose fibers on both sides of the non-woven.

To further improve the strength of the laminate and minimize delamination issues, an additional tissue layer can optionally be applied over the exposed side of the synthetic layer forming a trilayer sandwich-type structure. A commercially available tissue laminate non-woven is commercially available under the trade name Genesis technology is available from Ahlstrom Corporation (Two Elm Street, Windsor Locks, Conn., USA). The material is a bilaminate comprising a cellulosic tissue layer bonded onto a synthetic spun-bond layer composed of polypropylene fibers via the spun-lace process.

In the context of this invention, materials that comprise both hydrophilic and hydrophobic fibers are characterized as either hydrophilic or hydrophobic based on the 'moisture regain' test. The test is conducted by taking about a 0.5 to 1 gram sample of conditioned material, drying it in an oven at about 110° C. for 12 hours and then reconditioning it at higher humidity (65% Relative Humidity and 21° C.) for 5 days. After reaching equilibrium at 65% RH, the amount of moisture gained is measured as a percent: moisture regain=[(total conditioned sample weight at 65% RH−sample weight after drying)÷dried sample weight]*100%. For purposes of this invention, 'hydrophilic' material composites have a moisture regain at 65% at least about 2%, in another embodiment at least about 3%, in another embodiment at least 4% and in another embodiment at least about 5% and in another embodiment at least about 6%. Table 1 below shows a comparison of different fiber types for % moisture regain at equilibrium in 65% RH.

TABLE 1

| % Moisture Regain at Equilibrium in 65% RH | | | | | | | | |
|---|---|---|---|---|---|---|---|---|
| Hydrophilic Fibers | | | | | Hydrophobic fibers | | | |
| Cellulose | Rayon | Cotton | Acetate | Tri-acetate | Polyester | Acrylic | Polyethylene | Polypropylene |
| 12-15 | 11-13 | 7-8 | 6.0-6.5 | 4.0-4.5 | 0.4 | 1.5-2.0 | Below 0.1 | Below 0.1 |

Without wishing to be bound by theory, it is believed that the affinity of water for hydrophilic fibers (particularly those that are cellulosic in nature) is due to the presence of free hydroxyl or anionic groups on the substrate which serve as sorption sites. Water can be firmly chemisorbed to the fibers by hydrogen bonding and somewhat less firmly sorbed through secondary polar interactions. Dust can also be wetted and then sorbed onto the hydrophilic non-woven by aqueous solutions. Success of the chemisorption process depends on the ability of the cleaning solution and duster to overcome the soil-to-surface hydrogen bonding forces. More hydrophilic dusters maximize the energetics of soil adsorption through ionic and hydrogen bonding mechanisms that are weak or non-existent for hydrophobic dusters. Additionally, hydrogen bonding increases the friction between the duster and surface during the wiping motion, imparting better the mechanical action for pick-up and reducing the need for consumers to exert additional pressure. Finally, high absorbency of the hydrophilic material also guarantees enhanced siphoning of fluid, reducing the level of left-behind residue. By contrast, hydrophobic fibers, especially bundle fibers such as tow, and even cellulose acetate to a lesser extent, suffer from poorer kinetics and thermodynamics for adsorption, absorption and retention of fluids and embedded soils. In the presence of aqueous compositions, the bundles bunch up with each other so as to lower the interaction with water, and this can lead to the formation of lines during the cleaning process. Without the benefit of absorbency, the lines turn into streaks following dry-down of the aqueous composition.

Other non-woven layers and woven layers may optionally be used within duster pads of the present invention. These layers may include any combination of hydrophobic, hydrophilic and neutral layers. One of ordinary skill would readily understand after being instructed by this invention what additional layers may be incorporated.

Optional Synthetic Fiber or Bundle Fiber Layers:

The duster pad of the present invention optionally comprises bundle fiber layers. The bundle fiber layers of the present invention also include synthetic fibers. In one embodiment, bundle fiber layers are intermixed together with the hydrophilic non-woven layers of the invention in any manner. In an alternate embodiment, the bundle fibers are not situated on the outermost perimeter of the duster pad. Bundle fiber layers provide an opportunity to increase the versatility of the dusters of the invention by providing dry dusting capacity. Bundle fibers may also be incorporated for aesthetic reasons, for example, to improve the look, feel and fullness of the duster. Dry dusters are well known in the art and have been widely commercialized. While the bundle fibers of many commercial dusters are coated with wax and/or oils so as to provide increase retention of adsorbed soils, in one embodiment the bundle fibers of the present invention are uncoated. While coatings comprising tacky waxes and/or oils such do provide improved retention of adsorbed soils in dry applications, they can be washed away or rendered ineffective when placed in contact with aqueous media. When the bundle fibers comprise a coating, the coatings present on the bundle fibers of the dusters herein are in another embodiment not easily washed away and have tackifying properties that are not modified by dilute aqueous chemistry.

If fiber bundles or synthetic fibers are present, the weight a ratio of said fibers to hydrophilic non-wovens and/or absorbent ranges from about 10 to about 1, in another embodiment from about 5 to about 1 and in another embodiment from about 3 to about 1. If cleaning is more important than dusting, the weight ratio of fiber bundles to hydrophilic non-wovens and/or absorbent core is from about 2 to 1, in another embodiment from about 1 to about 1, in another embodiment from about 1 to about 3, and in another embodiment from about 1 to about 5.

Optional Absorbent Core:

The duster pad of the present invention optionally comprises an absorbent core. The absorbent core comprises a hydrophilic non-woven material with a caliper at least 0.4 mm thick at 0.1 psi weight that additionally has absorbency of deionized water of at least about 7 grams per gram of substrate. As such, the absorbency typically exceeds that of the hydrophilic non-wovens. The absorbent core can be produced by any process known in the art. In one embodiment the absorbent core is produced using the air-laid process. In the air-laid process, cellulose fibers or cellulose/synthetic fiber blends are suspended in the air and then separated by being laid onto a screen. The fibers are then deposited onto rotating perforated cylinders or moving screen belts. The synthetic polymer is typically a bicomponent comprising of a low melt point polyethylene on the sheath portion and higher melt point polypropylene or polyester as the core. This synthetic polymer is homogenously blended with the cellulose at ratios from about 5% to 25%. The batt of fibers is compressed and then sent through a heating such as an oven to partially melt the bicomponent which helps to fuse the fibers together. To reduce Tinting a chemical binder emulsion is sprayed on the outer surface of both sides of the web. The typical add-on is about 5 to 25% of dry binder to dry fiber weight. The aqueous formulation of the binder is typically 7-20% solids. The formulation typically consists of a latex binder, a surfactant to help penetration into the web and reduce de-lamination and a catalyst to accelerate the cross-linking reaction during curing. As in the case of the optional stiffening layer described below, the hydrophilic core is, in one embodiment, positioned in close proximity to the duster handle, thereby providing pressure points for cleaning and dusting applications.

Optional Duster Stiffening Materials:

The absorbent cores described above not only add absorbency but also help stiffen the wiping portion of the handle, providing rigidity for edge cleaning framed surfaces such as windows, mirrors, TV screens, and the like, and pressure points for stain and tough dirt cleaning. The absorbent core(s) can be positioned anywhere with respect to the duster pad. In one embodiment, the absorbent core(s) is positioned close to the wiping portion of the handle, in an alternate embodiment just below the non-wovens that directly contact the handle so as to maximize pressure points along the length of the duster wiping handle portion. Alternatively, dusters of the present invention comprise a stiffening layer that have limited absorbency properties. Non-limiting examples of suitable stiffening materials that are absorbent include cardboard, PVA foams, and waddings; non-limiting examples of suitable non-absorbent stiffening layers include as polyethylene, polypropylene and polyester films and mixtures thereof, rigid foams, rubber, wood, industrial non-wovens such as Type® and the like.

Optional Premoistening of Duster Hydrophilic Non-Woven Layers:

In one embodiment, one or more of the hydrophilic non-woven layers in the dusters are premoistened with a cleaning solution. In one embodiment, synthetic fibers and 'tow' fibers are not premoistened whereas fiber bundles composed of cellulose acetate are premoistened. Premoistened hydrophilic dusters comprise cleaning solution loaded onto said dusters at a load factor of from about 1 to about 10, in another embodiment from about 1.2 to about 8, in another embodiment from about 1.5 to about 7 and in another embodiment from about 2 to about 6 by weight of chemistry per weight of duster.

Optional Scrubbing Zone

The duster pad of the present invention optionally further comprises a scrubbing zone. The function of the scrubbing zone is to provide more abrasive cleaning to the surface to be cleaned. One of ordinary skill will readily know of many ways, upon review of this invention, to include scrubbing zones onto the duster pad and/or handle. In one non-limiting embodiment, hooks are located onto the duster pad to create a scrubbing zone.

DUSTER PAD EXAMPLES

The following are non-limiting duster pads examples provided to illustrate the duster of the present invention. Those skilled in the art will recognize that alternative designs can be made with the knowledge provided herein. Importantly, all the designs below incorporate a handle and hydrophilic non-woven(s). For purposes of simplicity, the handle design is kept the same throughout; those skilled in the art will recognize the opportunities to mix and match handle designs and duster composition designs. Many of the design illustrations below comprise both hydrophilic non-woven fibers and optional fiber bundle or synthetic fibers. Those skilled in the art will recognize that in a dry dusting context, the higher the fiber bundle or synthetic fiber content, the better the dry dusting performance. Conversely, the higher the hydrophilic non-woven content, the better the wet cleaning. As such, dusters of the invention can be optimized depending on the application need. Bundle fibers can also be incorporated into the duster design for the sole purpose of improving the aesthetic attributes or appeal of the dusters.

For purposes of clarification, the 'length of the duster' is defined as the direction parallel to the length of the handle A inserted into the duster and along the plane of attachment layers C & D. The actual length measurement is taken to correspond to the distance measured on the longest layer of the duster. 'Non-woven length' is the edge to edge non-woven distance for the specified non-woven along a vector parallel to the handle length.

The 'width of the duster' corresponds to the direction perpendicular to the length of the handle along the plane of the attachment layers C & D. The actual width measurement is taken to correspond to the distance measured on the widest layer of the duster. 'Non-woven width' is the edge to edge non-woven distance for the specified non-woven along the vector perpendicular to the handle length.

The "thickness of the duster" is defined as the dimension in the z-direction. For the purposes of the invention thickness is defined as "flat thickness" whereby the duster is kept in its original state when first removed from the package and "fluffed thickness" which is the thickness after the duster is loosened up using wave motions. Many of the designs described below have compressibility to allow to be used in tight spaces and resiliency which allows it to be effective to clean three-dimensional surfaces and maximize dirt trapping capacity of the duster. To measure this ability to vary thickness the duster's thickness in a flat position is first measured. "Flat thickness" is measured by removing the duster out of its package without disturbing it. Place the flat duster with the cleaning side facing down in a plexi-glass box. The box dimensions are about 1 cm greater in both the lengthwise and widthwise dimension of the duster to allow duster to fit without being hung up. The thickness is measured from the surface where the cleaning side of the duster touches to the highest most point on the opposite side of the duster furthest away from the surface. Using a ruler measure thickness at 5 different points along the length of the duster and 3 different points along the width. The average of these represents the flat thickness. To measure 'fluffed" thickness, grip the edges of duster in the lengthwise direction with fingers of each hand. On the corner of a table rub the duster cleaning side down vigorously using 10 strokes to loosen it up. Next using an "S" or "wave" motion move the duster up and down while gripping with the fingers to fluff it up. This should be done with 10 vigorous up and down movements. Place the fluffed duster with the cleaning side facing down gently into the plexi-glass box being careful not to compress it. Using a ruler measure thickness at 5 different points along the length of the duster and 3 different points along the width similar to flat duster measurements. The average of these represents the fluffed thickness. In one embodiment the ratio of "fluffed thickness" to "flat thickness" is from about 2 to 1 to 200 to 1, in an alternate embodiment from about 3 to 1 to about 100 to 1, and in an alternate embodiment from about 5 to 1 to about 50 to 1.

Duster Pad Example 1

Figure 5:
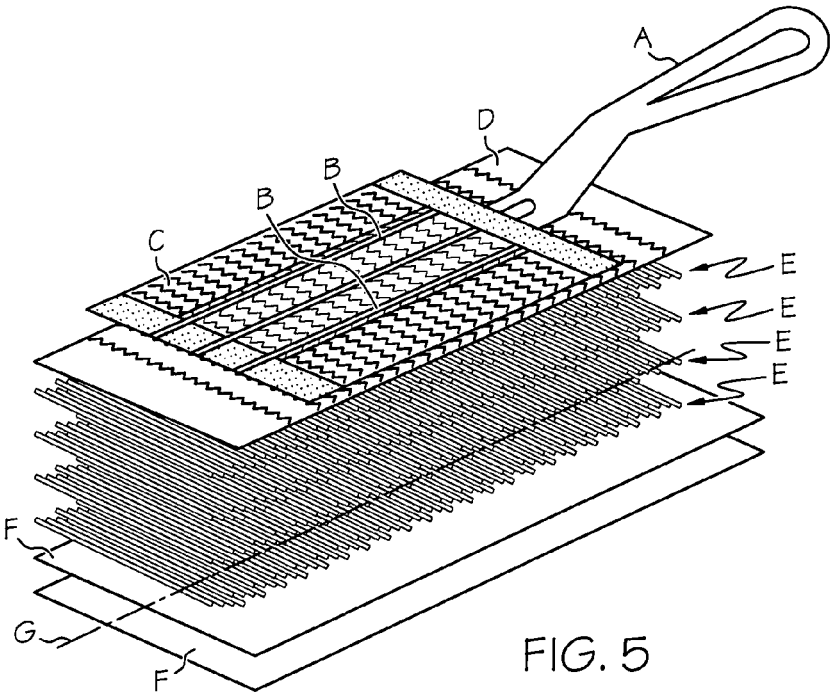
FIGS. 5 and 5*a* illustrate a duster having two non-woven sheets and a loop of non-woven sheet, respectively.

An example of the invention combining tow fibers with one or more hydrophilic cellulosic based non-wovens wherein the non-wovens are placed on the outer clean portion of the duster is shown in FIG. 5. Handle A inserts into pocket B formed by bonding the side of a first non-woven layer C with attachment side of a second non-woven D. Below the attachment side non-wovens, one or more synthetic or fiber bundle layers E (continuous strands of tow fibers) are partially bonded to the attachment side non-woven base material D. Below the fiber bundle layers E, one or more hydrophilic non-wovens F are partially bonded, in another embodiment using a single seal G to the fiber bundle layers E. Attaching the hydrophilic non-woven using a single seal along the length of the duster provides has some freedom of movement for the non-woven during the wiping process due to availability of free ends. The ability for the non-woven to move back and forth is particularly important in allowing some of the fiber bundles to be exposed, especially for dry dusting. The single seal G and dual seals B can be continuous or discontinuous. The availability of hydrophilic and bundle fiber layers allows for effective performance wet or dry.

Figure 5A:
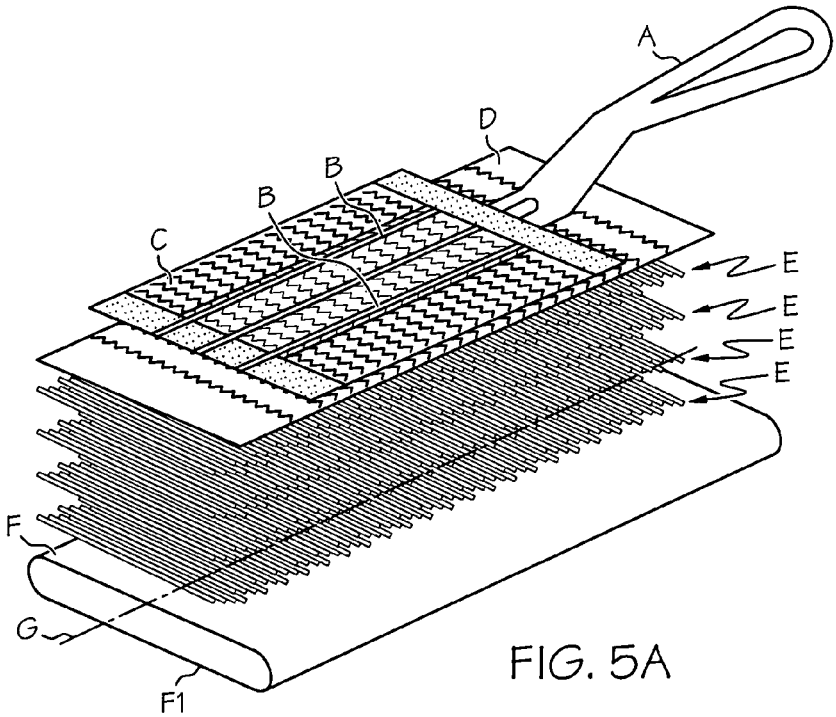

FIG. 5A is similar to FIG. 5 with the exception that the hydrophilic non-woven is in the form of a loop configuration F1. The loop is formed by taking the ends of two non-woven layers and folding them toward each other and then tacking them down around on each other.

Duster Pad Example 2

Figure 6:
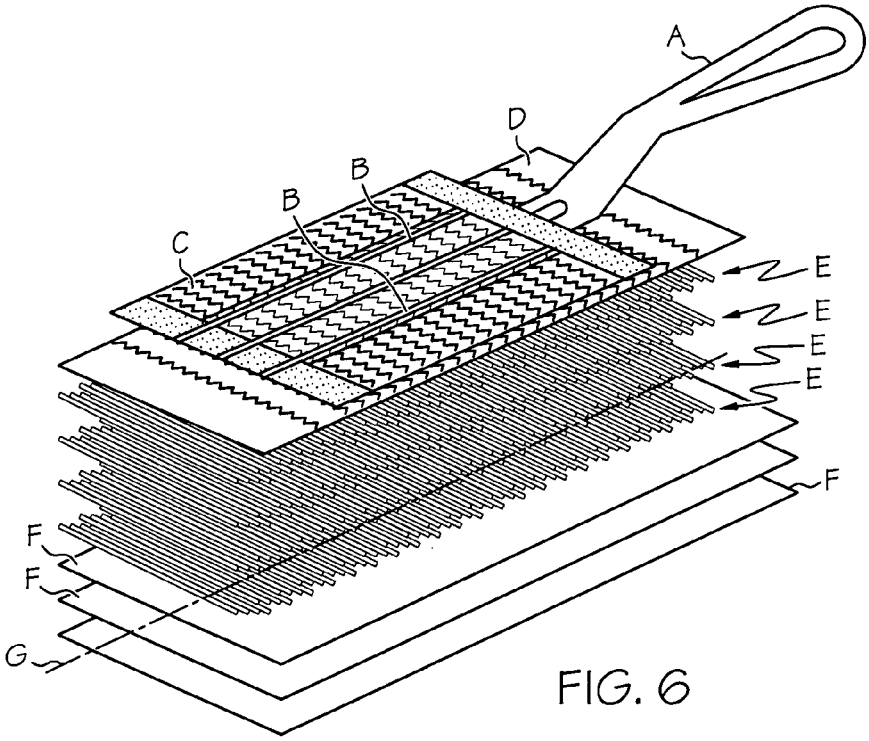
FIGS. 6 and 6A illustrate a duster having straight non-woven layers and loop non-woven layers, respectively.
Figure 6A:
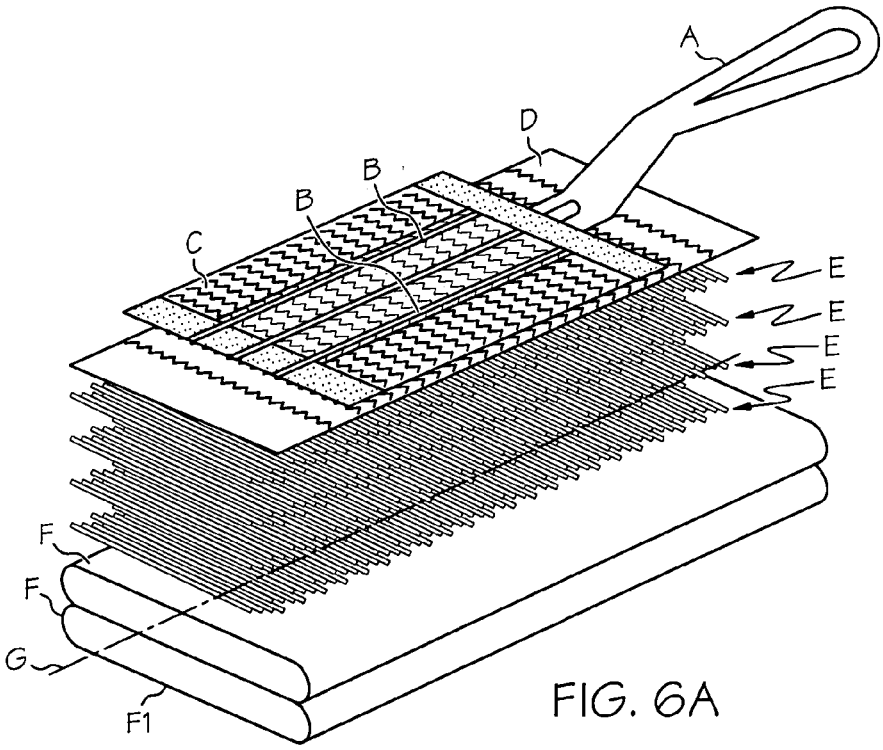

Alternative embodiments are shown in FIG. 6. All the elements remain the same as in FIG. 5 with the exception of the hydrophilic cellulosic based non-wovens F which are cut into a plurality of strips emanating from the axis defined by the length of the handle A. One bonding process is a single seal G that runs the length of the pad which is the dimension parallel to the handle A. Cutting the hydrophilic non-wovens into a plurality of strips, thus creating even more free ends, improves freedom of movement back and forth during the dusting process and allows even more exposure of the bundle fibers (tow and/or cellulose acetate) for aiding dust pick-up. The plurality of strips also increases non-woven three-dimensional surface area during use, reaching better into tight spaces and enhancing utilization of the non-woven fibers. FIG. 6A is similar to FIG. 6 with the exception that the non-wovens used to form the plurality of strips is in the form of loops F1. This duster design provides effective performance wet or dry.

Duster Pad Example 3

Figure 7:
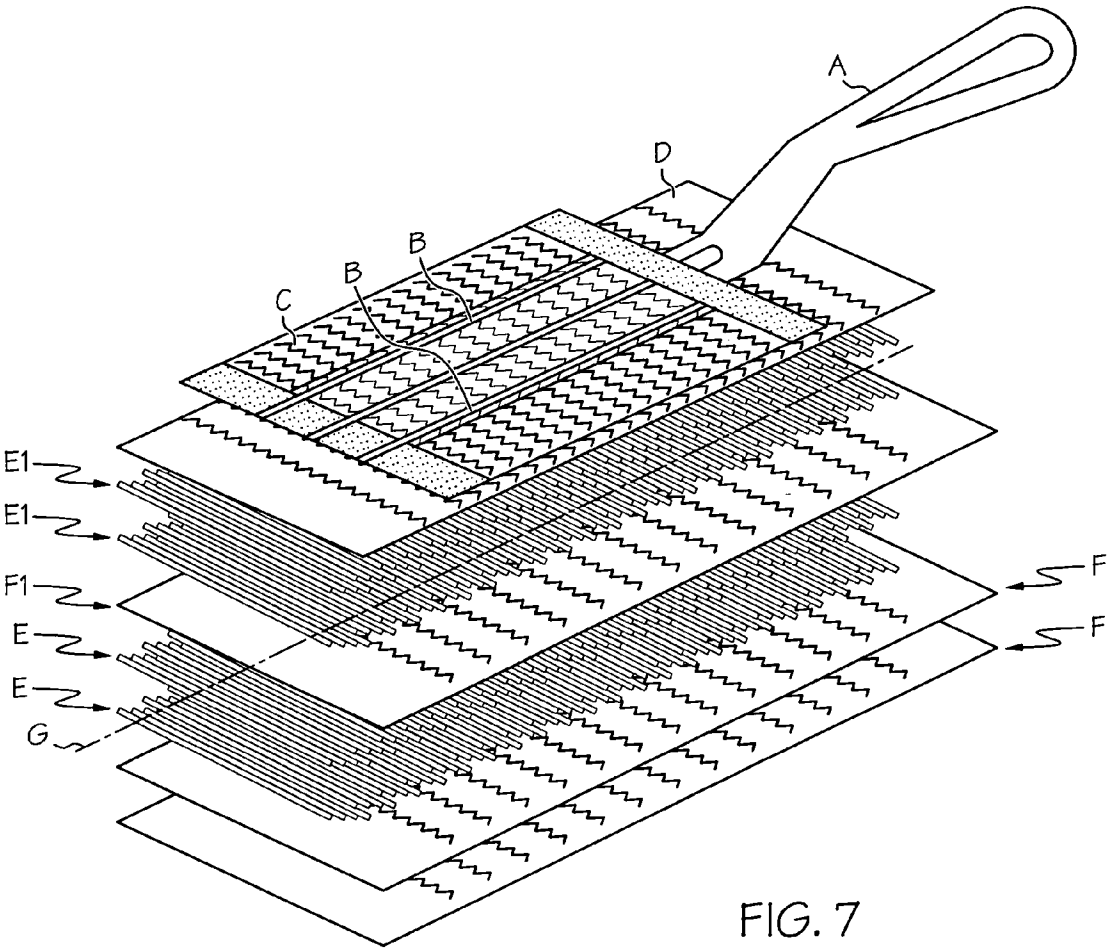
FIG. 7 illustrates a third alternate duster comprising a hydrophilic non-woven

An alternative embodiment is shown in FIG. 7. All the elements remain the same as the design in FIGS. 6 or 6A with the exception that one set of hydrophilic non-woven layers F are placed on the outer cleaning portion or below fiber bundles E. One or more additional layers of hydrophilic non-wovens F1 are, in one embodiment, placed between layers of fiber bundles E1 located closer to the handle. Having hydrophilic layers between layers of fiber bundles provides higher absorbency zones between the fiber bundles E and E1. In embodiments where the fiber bundles are comprised of synthetic fibers (especially tow), the higher absorbency zones aide in drawing moisture away from the synthetic fibers so that they do not get saturated. Optionally, the hydrophilic non-woven F1 located between the fiber bundle layers E and E1 and the hydrophilic non-woven F located on the outer cleaning side of fiber bundles E can also be in the form of loops as shown in FIG. 6A. This duster design provides effective performance wet or dry.

Duster Pad Example 4

Figure 8:
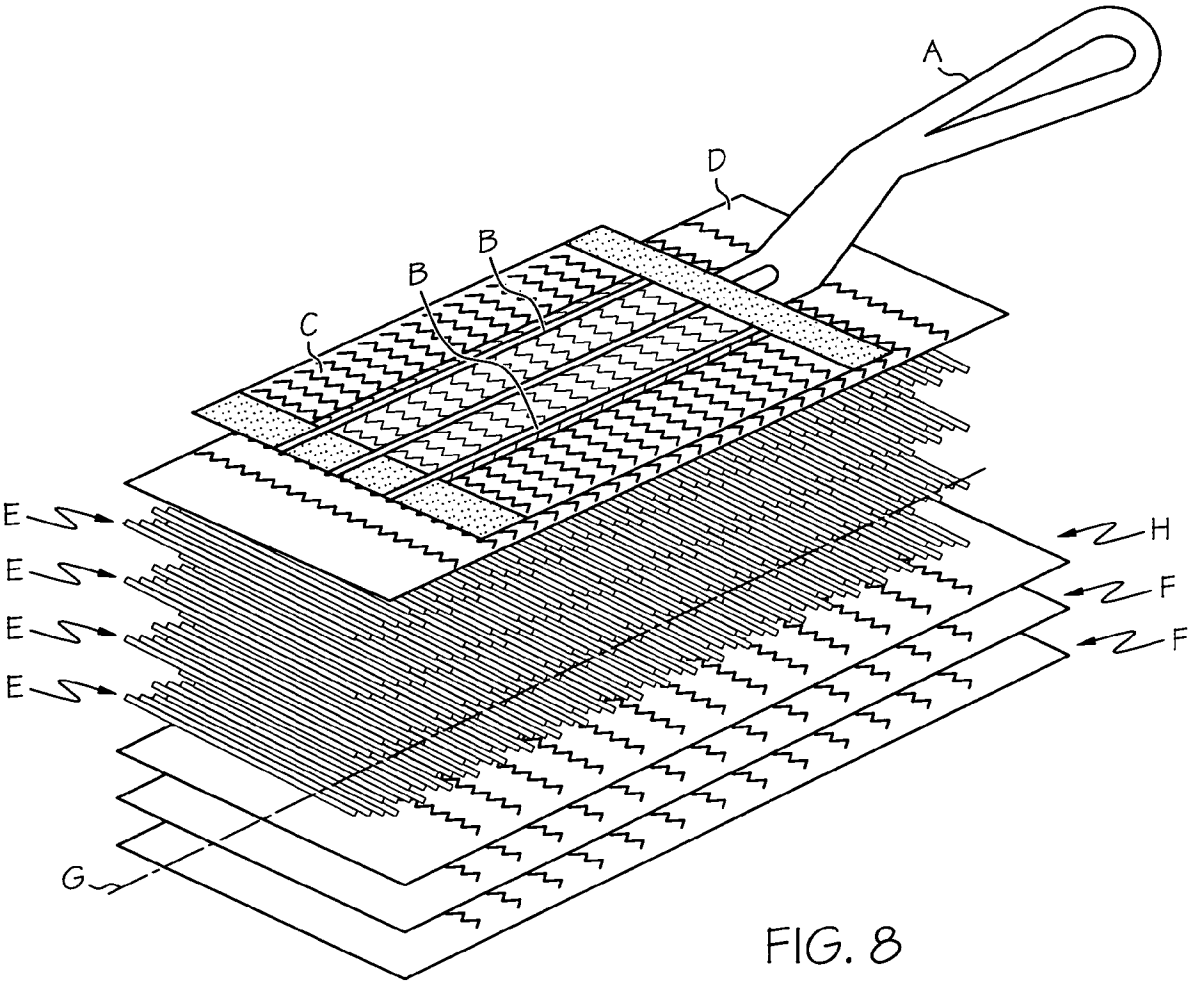
FIG. 8 illustrates a duster comprising a non-woven and an absorbent core.

An alternative embodiment is shown in FIG. 8. All the elements remain the same as the designs shown in FIG. 6 or FIG. 7 with the exception that one or more absorbent core layers H are added between the fiber bundle layers E and the hydrophilic non-woven layers F (or F1 if the strips are looped). An Absorbent core adds even higher absorbent capacity and thickness than that provided by the hydrophilic cellulosic layers, helping fluid trapping and retention, which is especially useful for cleaning and dusting applications that use high solution dosing levels. The core also provides increased rigidity to the duster, strengthening the product appearance. Enhanced rigidity also provides additional degrees of freedom with respect to handle design. Thus, while flexible handles help ease of use, they can be also appear or be flimsy. In such cases, an absorbent core can be used to create pressure points along the length of the handle enhancing tough cleaning and scrubbing properties. The combination of the core and hydrophilic non-woven formed into strips provides the opportunity to deliver the tough cleaning of a pre-moistened wipe and the reach into tight spaces of a traditional duster within the same execution. This duster design provides effective performance especially wet, but can also be used dry.

Figure 8A:
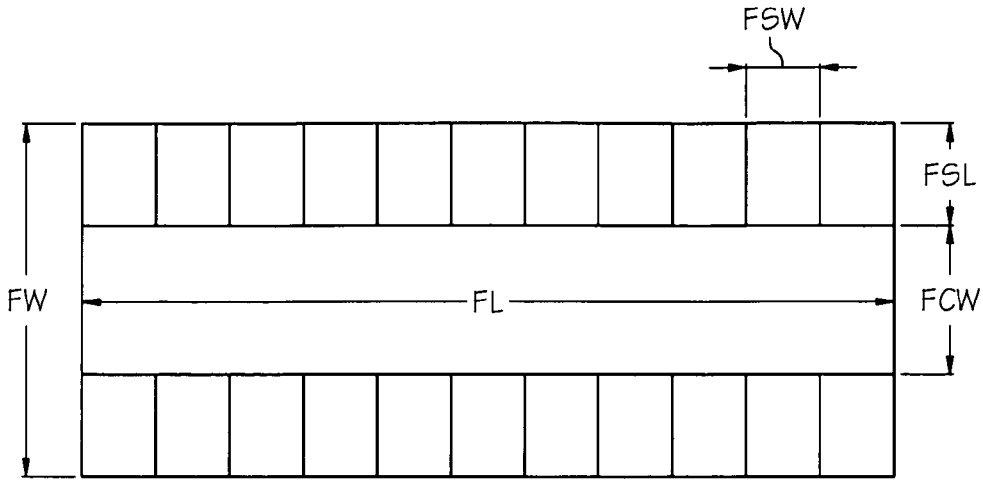
FIG. 8*a* illustrates a top view of the cut pattern of the core or hydrophilic non-woven.

It is recognized that the fibers from the fiber bundles can penetrate in between gaps created by cutting the core and hydrophilic non-woven into strips. As these bundle fibers penetrate through these spaces, they can interrupt absorption and friction from the hydrophilic non-woven. An even better design is diagrammatically illustrated in FIG. 8A, which shows a top view of the cut pattern of an absorbent core and/or the hydrophilic non-wovens. In this design the cuts made to form the strips in the width dimension are not continuous and the center portion of the core and/or gather strip remains a solid strip across the entire length FL. The dimension of the cut strip length FSL and dimension of the uncut center width FCW are optimized to minimize fiber bundle penetration while still having enough cut strip length to allow strip to move back and forth. The dimension of the uncut center width FCW is in one embodiment about 25 to 75% the width of the duster FW, in an alternate embodiment about 30% to 65% the width of the duster FW and in an alternate embodiment about 50% the width of the duster FW.

Duster Pad Example 5

Figure 9:
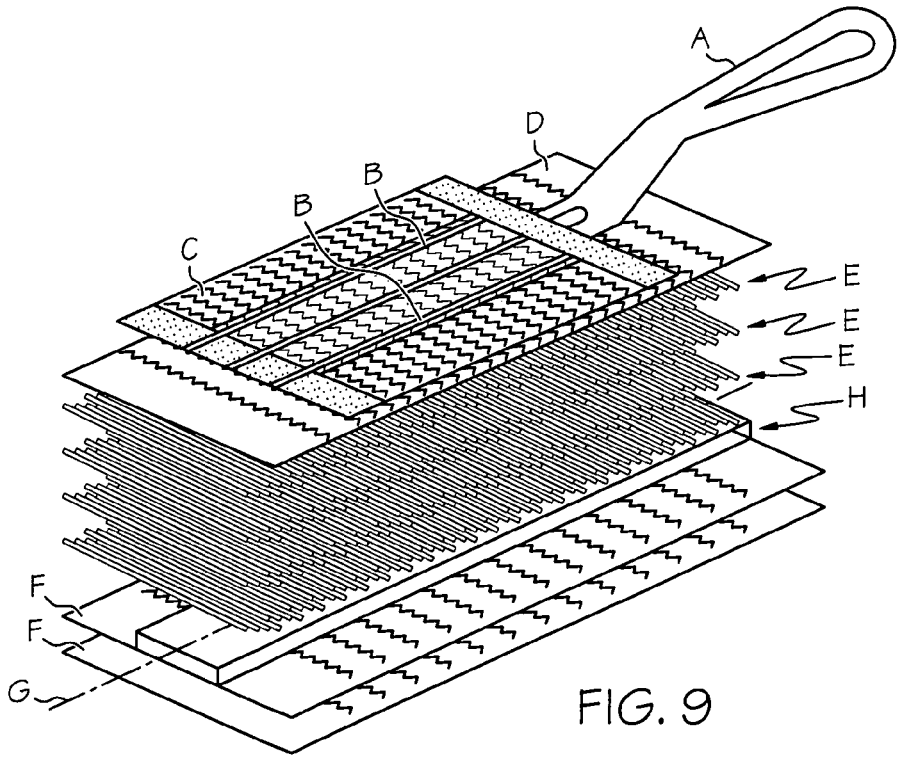
FIG. 9 illustrates an alternate duster comprising a non-woven and a narrow absorbent core.

An alternative embodiment is shown in FIG. 9. All the elements remain the same as the designs shown in FIG. 8 with the exception that absorbent core layer H is essentially a solid piece in the x-y dimension positioned in the center of the pad that is not cut into a set of moveable plurality of strips. In one embodiment the width-wise dimension of the absorbent core is narrower than the width of fiber bundles E. In one embodiment from about 25% to about 75%, in an alternate embodiment about 25% to 60% and in an alternate embodiment from about 40% to 60% the width of the fiber bundles E. In one embodiment, the fiber bundles E do not contact the cleaning surface. Since these fiber bundles E comprise of thermoplastic synthetic fibers they do not absorb well and can negatively affect the friction and absorbency of the hydrophilic non-wovens. Positioning one or more solid absorbent cores between the fiber bundles E and the hydrophilic non-woven plurality of strips F (or F1), substantially prevents the fiber bundles from penetrating through the spaces between the pluralities of strips. This mitigates interference caused by the fiber bundles on the cleaning ability of the hydrophilic non-woven strips. In essence, the duster is optimized to have two different cleaning zones. The outer face of the duster represents the portion of the duster optimized for cleaning surfaces such as glass mirrors and windows where high absorbency and ability to smooth-out solution is important for avoiding streaks. The sides of the duster are optimized for removing dust since fiber bundles typically provide a greater surface area and greater number of attachment points for dust to get trapped.

Duster Pad Example 6

Duster Pad Example 6 comprises a handle, hydrophilic non-wovens cut into strips, and an optional solid core. It does not include the fiber bundle layers of Duster Pat Examples 1 to 5 shown in FIGS. 5 through 9. Removing the bundle fibers from the design optimizes the duster for wet cleaning and dusting applications and discourages dry usage relative to the designs disclosed hereinbefore. This design is particularly well suited for the cleaning of surfaces that require significant levels of aqueous fluid such as glass including mirrors and windows. The design is also effective for picking up dust particularly in a dampened form.

A alternate embodiment of the design is shown in FIG. 10. Starting with handle A which inserts into pocket B formed by bonding attachment side first non-woven layer C with attachment side second non-woven D. Below the attachment side non-wovens, one or more absorbent cores H are bonded to the attachment side non-woven base material D. Below the absorbent core layers H, multiple layers of hydrophilic nonevents F (or F1 if the layers are formed into loops) form the outer portion of the duster architecture.

In another embodiment one or more hydrophilic layers just below the attachment non-wovens C and D are bonded using a wide dual seals such as those shown by B1. The wide dual seals are intended to be positioned outside the edges of the absorbent core H. Below these hydrophilic layers one or more layers are bonded using dual seals B2 which are narrower in spacing compared to the wide dual seals used to encase the core B1. Below these layers one or more additionally hydrophilic layers are attached using a single seal G. To optimize the fullness of this type of duster, the number of attachments point seals and the width of the attachment point seals of the various layers are in another embodiment configured such that the layers closest to the handle have wider attachments points whereas layers further away from the handle have narrower attachment points. Specific executions of this idea depend on the number of layers and the stiffness of the layers. By having the width of the bonding go from wide to narrow, the layers create a more uniform semi-circle shape when the fibers get wet. The bonding configuration used to make the seals can be continuous or discontinuous. The bonding can be achieved through any means including thermal, mechanical, pressure, ultrasonic bonding, adhesive bonding, sewing and any combinations thereof.

Duster Pad Example 7

Figure 11:
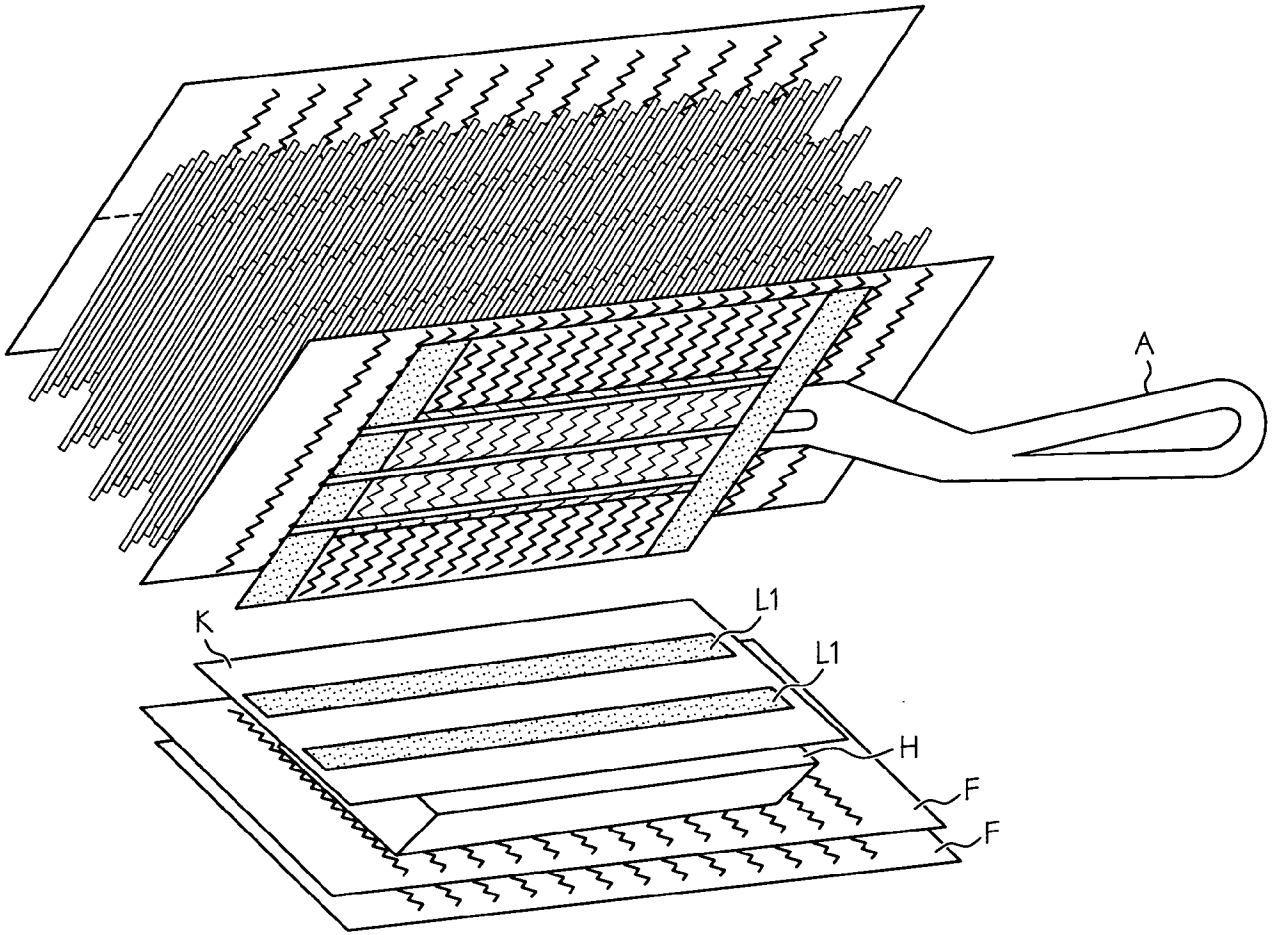
FIG. 11 illustrates a duster capable of two sided wet and dry cleaning.

Duster Pad Example 7 shown in FIG. 11 comprises two sides, a first side comprising a handle and bundle fibers, such as tow fibers, in another embodiment tow fibers, and a second side comprising a fastening mechanism to attach hydrophilic non-woven fiber layers to the duster wiping portion of the handle. The first side of the duster is structurally and compositionally similar to the commercially marketed Swiffer® Duster. As such, it provides excellent dry dusting benefits. The second side, intended for wet dusting and cleaning applications, comprises several layers of hydrophilic non-wovens F in another embodiment cut into a plurality of strips and an absorbent core H positioned above the strips closest to the attachment side. Above the core a barrier layer K is attached to the duster wiping portion using any fastening mechanism means known in the art. The fastening mechanism can consist of, for example, tacky polymers (e.g. polyisobutylene polymers, N-decylmethacrylate and mixtures), pressure sensitive adhesives (e.g., HB FULLER with trade names HL-1496, HL-1500, HM-1597, HM-1902, HM-1972, HM-2713), oil gels (e.g., National Starch SoftGel 546-47E) or waxes like paraffin, beeswax or microcrystalline waxes. With this two sided duster design consumers can use a spray bottle for wet dusting. In one embodiment the barrier layer is a water impermeable such as a polyethylene film. An alternative attachment can comprise of hooks L1 positioned on top of the barrier layer. These attachment hooks are in another embodiment low cost such as those used in attachment of disposable diapers. Commercially available examples of hooks include Aplix 963, 964, 731 and 946 manufactured by Aplix Inc. (123000 Steele Creek Rd., Charlotte, N.C., USA).

Duster Pad Example 7 clearly separates the hydrophilic non-woven layers from the layers designed for dry dusting. As such, it intuitively conveys suitability as an all-in-one system for dry dusting and wet dusting and cleaning. The clear delineation of the fiber bundles from the hydrophilic non-woven layers allows incorporation of tacky coatings such as wax, oils, pressure sensitive adhesives and tacky polymers onto the bundle fibers for dust trapping, because of reduced concerns related to the effects of aqueous chemistry. For example, instructions for use can encourage to first dry dust using the first side of the duster, and then attach the hydrophilic non-woven layers to the back side of the handle wiping portion for wet dusting and cleaning applications. Duster Pat Example 7 shows an angled duster handle connector portion; it can be optimized by making it flat like the one shown in FIG. 2. This makes the duster more ergonomically friendly, allowing the user to easily turn the flip the handle gripping portion 180° to change from dry dusting to wet dusting without the handle bumping the surface. Alternatively, to easily change from dry to wet, the forks pivot 360 degrees as illustrated in U.S. application Ser. No. 11/436,441 to Bonilla, the entirety of which is incorporated by reference. In yet another embodiment the handle has swivel joint at the transition portion of the handle. The swivel joint allows the gripping portion of the implement to be kept in a constant position, but the attachment portion of the handle to be turned 180° in order to switch from dry duster to wet duster. In this design the connector portion of the handle can be kept in angled.

Duster Pad Example 8

Figure 12A:
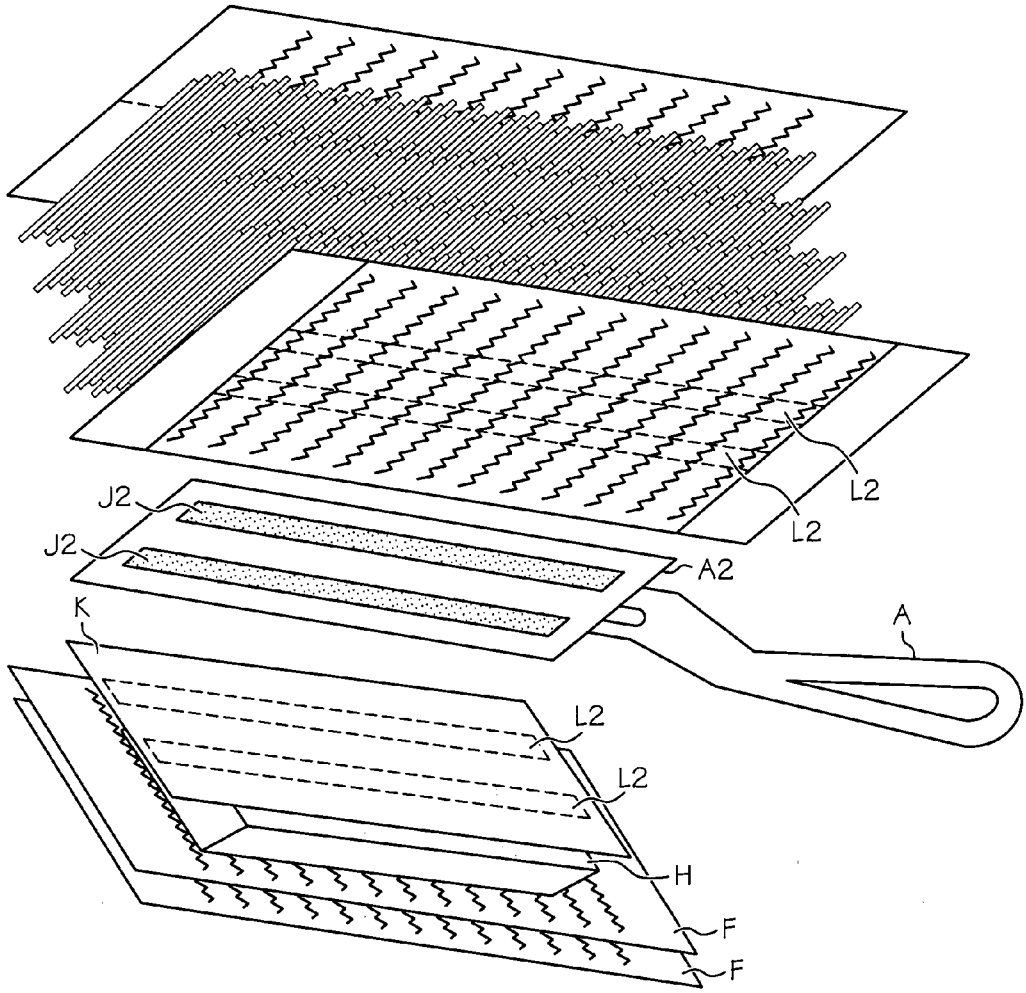
FIG. 12 illustrates a duster having a hook and loop attachment mechanism for wet and dry dusting.
Figure 12B:
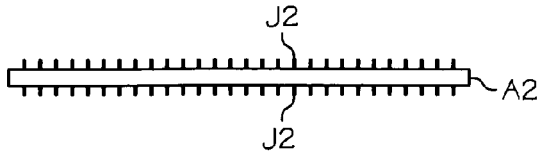

An alternative two sided system is shown in FIG. 12. The implement wiping portion A2 has Velcro® hooks J2 for attachment on both sides of the wiping/attachment portion A2. The dry dusting fiber bundles and hydrophilic non-woven layers can be secured to the hooks as previously described.

Duster Pad Example 9

Figure 13A:
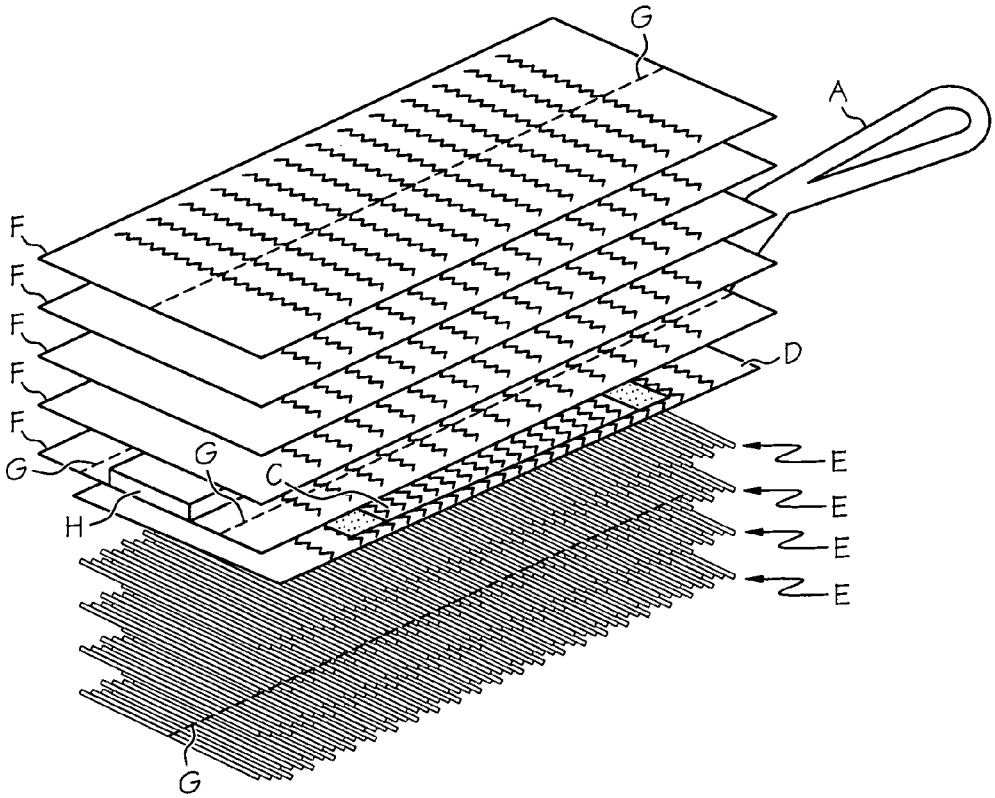
FIG. 13 illustrates an all-in-one dry and wet duster design.
Figure 13B:
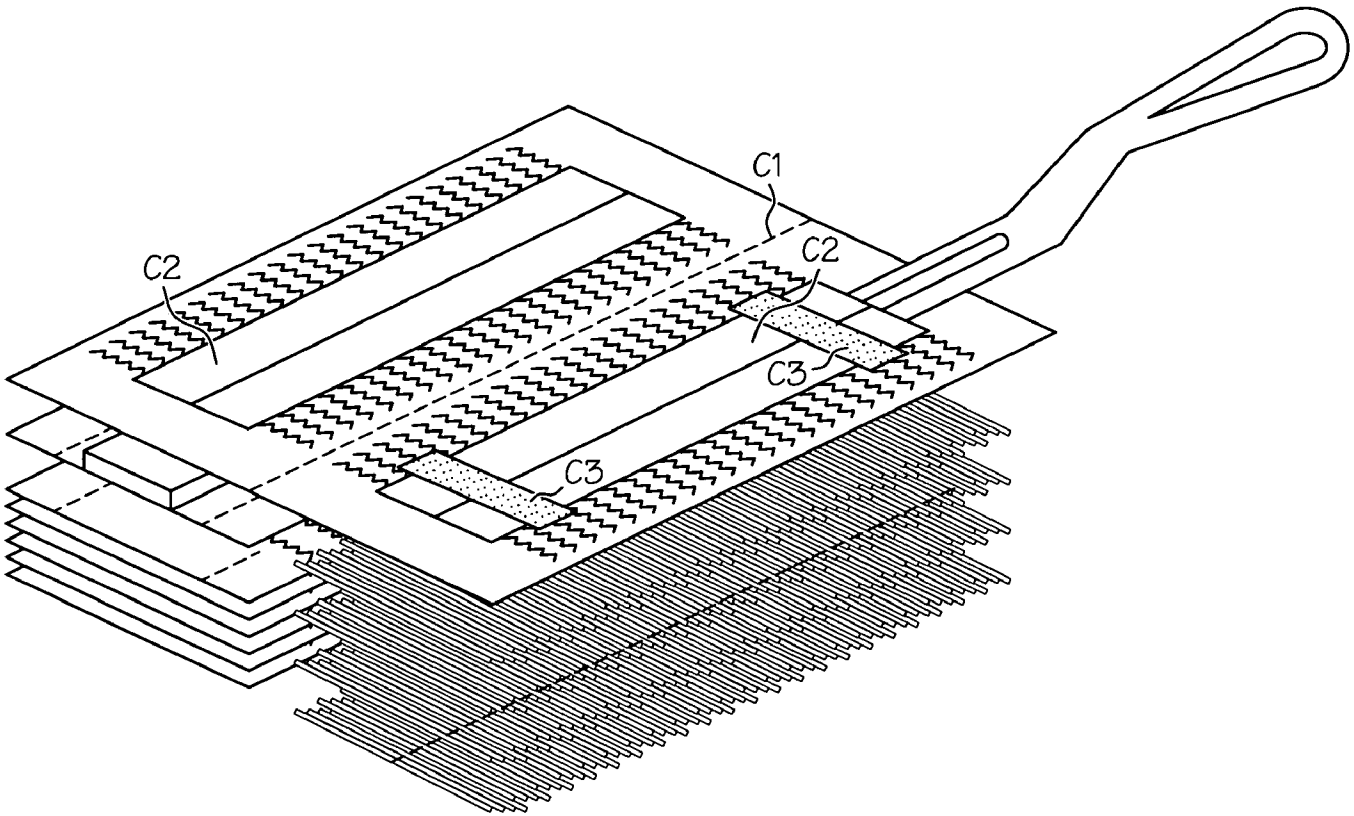

An alternative two sided system is shown in FIG. 13. This example is an all-in-one Dry and Wet duster. The implement A inserts into a pocket formed with non-wovens C and D located in the center of the duster. On one side of the duster hydrophilic non-wovens F and absorbent core H are position similar to designs described above. On the other side one or more synthetic or fiber bundle layers E (continuous strands of tow fibers) are attached using a single seal G. In an alternative embodiment the non-woven on the wet duster which is closet to the handle is perforated along its length just outside the dual seal bonds. This perforation allows the wet portion of the duster to be peeled off as it becomes exhausted, allowing continued use of the dry duster portion. Perforations can call be incorporated on the attachment non-woven of the dry duster portion should the opposite be required where the dry gets exhausted before the wet. Alternative all-in-one designs are contemplated. A duster in a side by side configuration is illustrated in FIG. 13 as Duster Pad Example 9A. In this Duster Pad Example 9A the left or right side is designed for wet dusting while the opposite left or right side is designed for dry dusting. Both the left and right side are two separate and distinct cut portions for the majority of the duster with the exception of the attachment non-woven C which is one piece where both the left and right side are attached. With this design the user places the wiping part of a handle on the left or right side of the combination duster. Then the opposite end is folded over creating a two-sided duster. The handle is held by inserting into one or more pockets C2, Velcro or other attachment means. As the duster is folded over, in one embodiment an additional attachment mechanism is provided to keep the two-sided configuration in place C3. The attachment mechanism includes adhesive, Velcro, hook and loop fasteners, mechanical such as grippers and the like. Perforations are added to allow the right side to be separated from the left side C1.

Duster Pad Example 10

Figure 14:
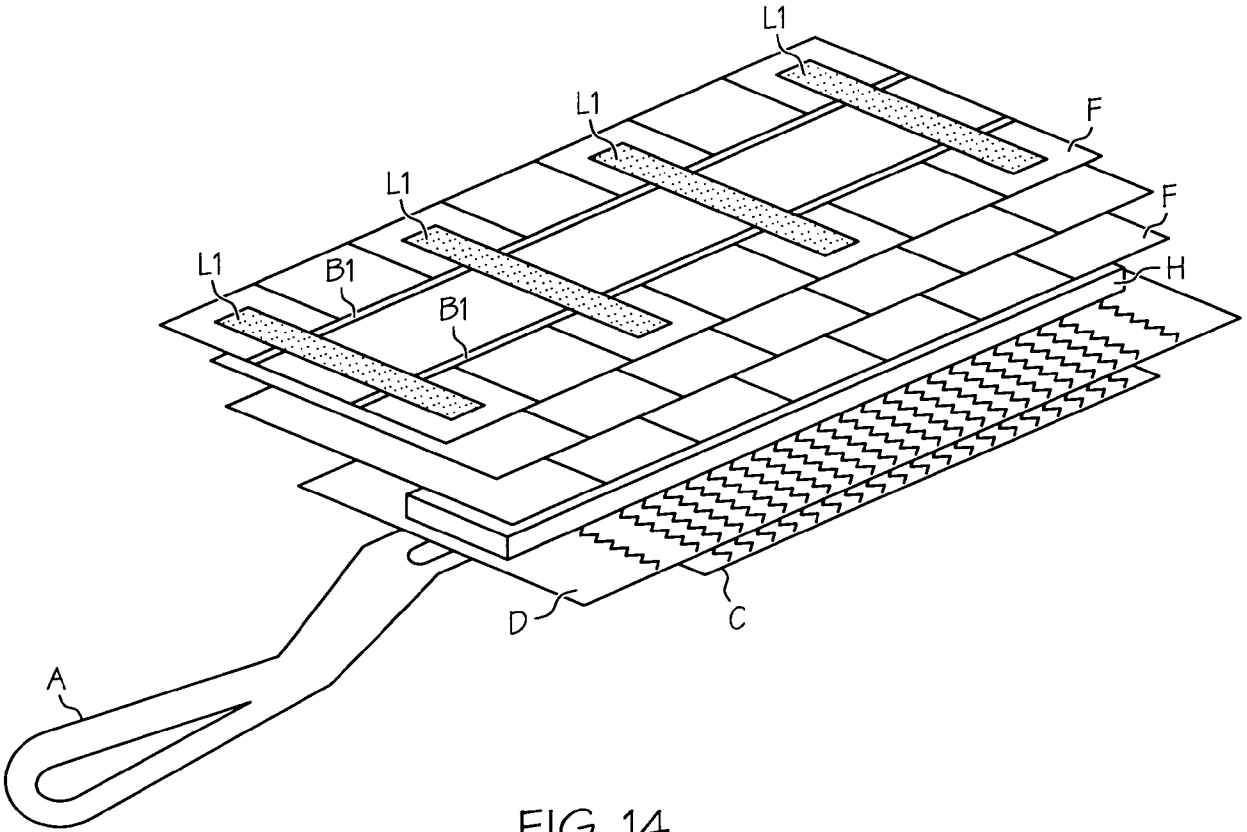
FIG. 14 illustrates a duster capable for fabric and carpet cleaning

Duster Pad Example 10 shown in FIG. 14 comprises a handle, hydrophilic non-wovens, and an optional solid core. The hydrophilic non-wovens F can in another embodiment be cut into a plurality of strips. In this design the cuts made to form the strips in the width dimension are not continuous and the center portion of the gather strip remains a solid strip across the entire length similar to the design shown in FIG. 8A. Further the non-wovens F are bonded using a two bond lines B1 to limit movement. For cleaning fabrics and carpets, the duster further comprises Velcro® hooks L1 positioned on the outer portion of the outer most hydrophilic non-woven. These hooks can function to scrub and to pick-up and retain hair and lint. Commercially available examples of hooks include Aplix 963, 964, 731 and 946 manufactured by Aplix Inc. (123000 Steele Creek Rd., Charlotte, N.C., USA).

Duster Pad Example 11

Figure 4:
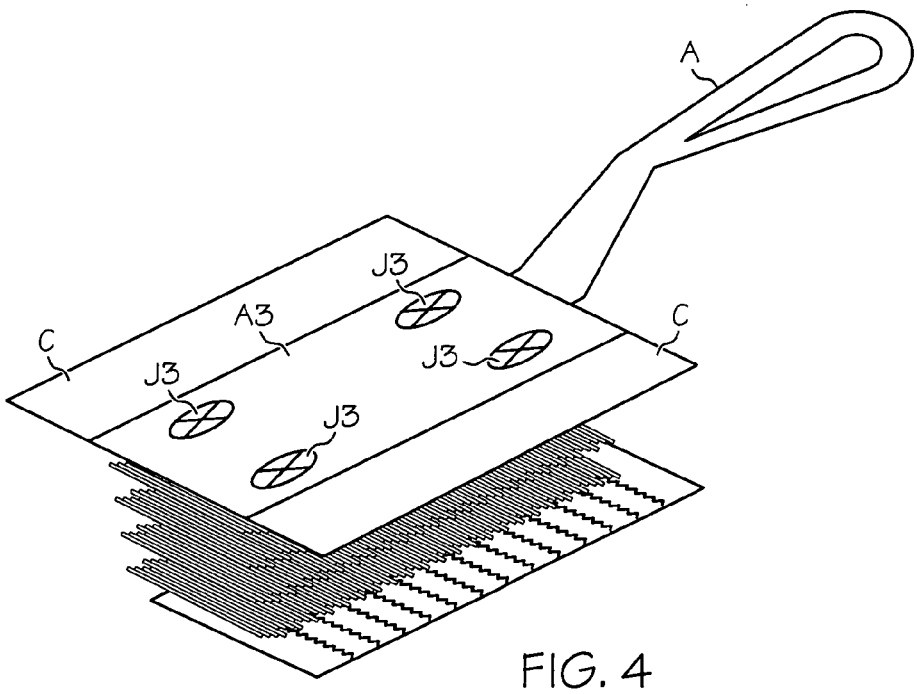
FIG. 4 illustrates a duster comprising gripper attachments.
Figure 15A:
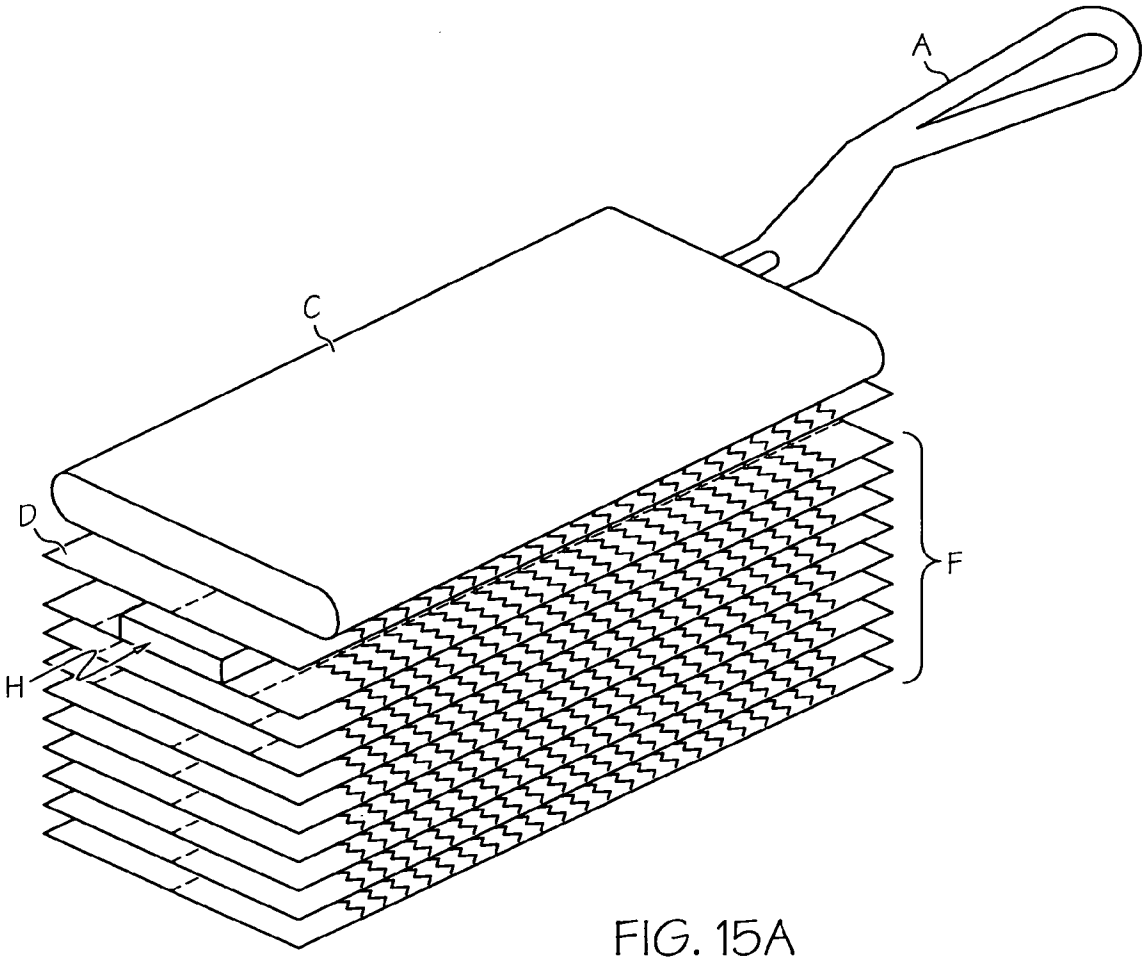
FIG. 15 illustrates a duster sheet capable of attachment to a handle or to a user's hand.
Figure 15B:
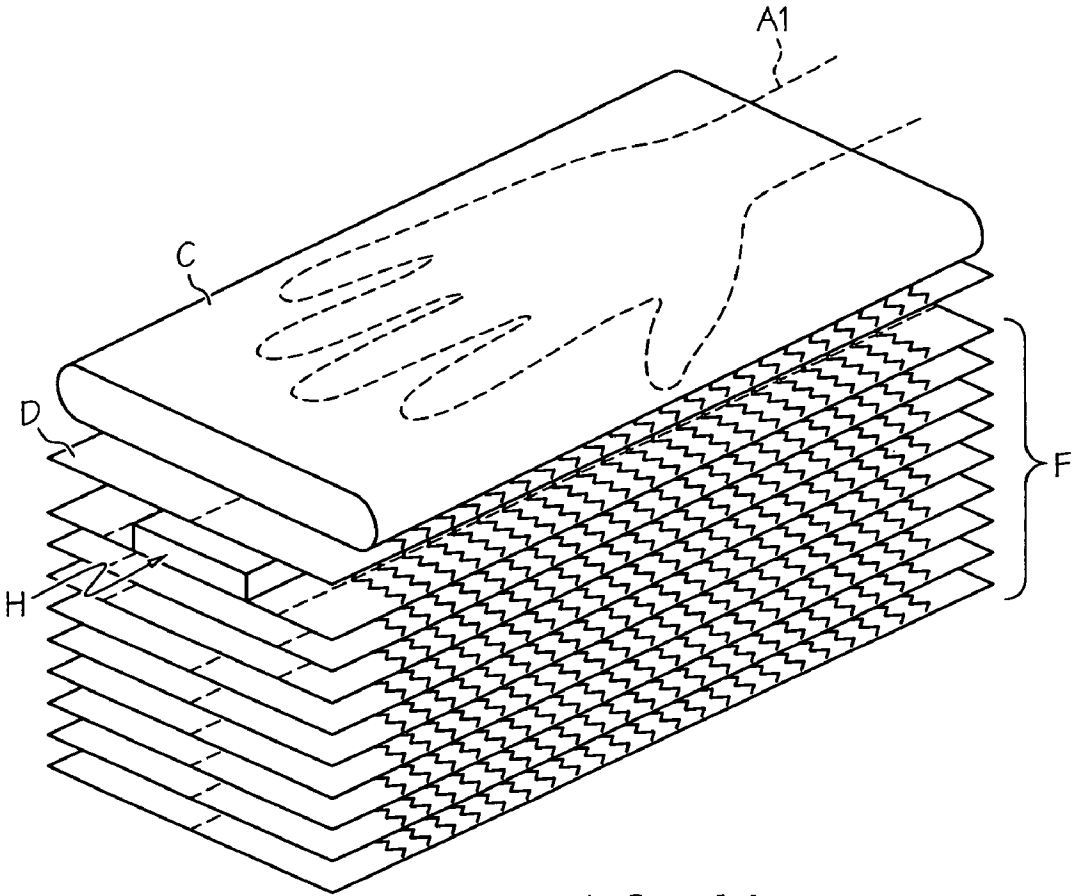

Duster Pad Example 11 shown in FIG. 15 comprises a handle, hydrophilic non-wovens, and an optional solid core similar to duster pad example 6 shown in FIG. 10. The modification in the design is the attachment portion. This duster is designed such that it can be attached to a handle or used by hand. Using the duster by hand can provide the user flexibility for jobs that require extra pressure or buffing. In duster pad example 11 the non-woven C is about 2 times or more the width of the duster. This non-woven can be folded over onto itself and bonded at the end to form a large pocket or bag-like opening. The user simply slips their hand into the large pocket to use the duster by hand. Below this large pocket the duster maintains dual seals to allow for implement forks to be attached. In this design, alternative means for attachment are contemplated such as those shown in FIGS. 3 and 4. It is also understood that the larger pocket for inserting the users hand is pre-formed on the duster or formed by the user by folding over non-wovens and attaching them together using adhesive, Velcro and the like. Alternative embodiments have series of two or more smaller pockets where rather than inserting the entire hand into one large pocket the user inserts one or more fingers into two or more smaller pockets. In further alternative embodiments rather than insert a hand into a pocket, non-wovens are used to construct extensions from the duster. These extensions provide a means for gripping the duster with the users hand and wiping it on a surface.

Friction Testing:

Without intending to be bound by any theory, it is believed that the higher affinity for water of naturally derived hydrophilic fibers is due to the presence of hydroxyl groups that serve as sorption sites. Additionally, as these sorption sites absorb water, they also provide 'grip' or friction on the surface.

When a body moves over a horizontal surface, it presses down against the surface with a force equal to its weight, i.e., to the pull of gravity upon it; an increase in the weight of the body causes an increase in the amount of resistance offered to the relative motion of the surfaces in contact. In the case of a duster pushing across a wetted surface, the level of hydrogen bonding between duster, aqueous medium and surface determine the amount of additional force required to push the duster across the surface: the greater the hydrogen bonding levels, the more force is required to break those bonds, and hence, the greater the friction. Friction forces are is maximized when the water molecules from the aqueous medium can hydrogen bond to both the surface to be treated and the duster fiber composition. This is achieved when the surface and the duster are both hydrophilic, each comprising high levels of free hydroxyl (—OH) groups. As such, high friction is achieved when dilute aqueous compositions are used with a cellulosic duster on glass surfaces. Two of the three criteria can be directly controlled by product design: the amount of water in the aqueous composition and the amount of cellulose in the duster. High friction is a key design parameter for the duster/solution combinations for the present invention because improved duster friction simultaneously provides better surface coverage and improved soil removal. As such, friction testing can help differentiate the inventive dusters from those of the prior art.

It has been found that higher wet surface friction is achieved even in compositions where oils and other non-water soluble chemistries are formulated as emulsions with aqueous compositions. For example many furniture polishes contain oils and hydrocarbon solvents. These ingredients typically create lubricity which reduces surface friction. Friction testing of various duster designs is described below:

"Coefficient of Friction" Test Method

In order to evaluate friction in a wet environment, dusters of varying substrate compositions are tested using a "Coefficient of Friction" test. This test method uses a Friction/Peel Tester Model 225-1 (from Thwing-Albert Instrument Company, Philadelphia, Pa., USA 19154). This instrument can be used to measure both the static and kinetic coefficients of friction of a material. The coefficient of friction of a duster can be viewed as the number U which is equal to the resistive force of friction Fr divided by the normal or perpendicular force pushing the objects together Fn. Static force measurements represent the friction caused by a duster as it is first pushed across a surface starting from a rest position. Kinetic force measurements represent the friction as the duster is continuously pushed across a surface.

Preparation of the Sample Material to be Tested

Duster samples to be tested are positioned to determine the length and width of the duster. With the duster positioned in the lengthwise dimension remove 2 cm from the outer edges of the duster cutting parallel to the width dimension (dimension perpendicular to the length in which handle attaches). Then cut a sample 7 cm wide with the cut being made in the direction parallel to the width of the duster. The dimension of the duster sample for testing is 7 cm long by the actual width dimension of the duster which is whatever it may be for the specific duster. This dimension varies for different dusters but is typically somewhere between 10 and 20 cm. A 200 g sled composed of metal is covered with a 2 mm thick dense foam on its top and bottom surfaces and then further covered with a plastic laminate material for water proofing. The sled dimensions are 6.5 cm wide ×6.5 cm long by 1.5 cm thick. The bottom of the sled has Velcro hooks for attaching the duster sample. The 6.5 cm by 6.5 cm sled is carefully positioned over the center of the duster sample. The pressure per unit area created by the sled is about 5 g/cm$^2$. This pressure simulates a typical amount of pressure applied by a duster used in wet cleaning.

Preparation of the Test Surface and Testing with Deionized Water—

Test Surface:

The test surface is a smooth, tile made of tempered glass such as that used for patio doors and windows. The glass tile is 7.5 cm wide 30.5 cm long and 0.5 cm thick.

Test Solution—De-ionized Water

Test Procedure:

1. Press the "Sled" button repeatedly until the sled weight displayed is 200 g (corresponding to the weight of sled used in the test)
2. Press the "Test Time" button repeatedly until 20 seconds is displayed for time.
3. Set the speed of the sled by pressing the "Test Speed" button at 1 cm/sec (in order to check press speed, press test, press return)
4. Using the "Return" switch, position the Load Cell to the starting point for test.
5. Clean the glass tile using a solution comprising of 20% IPA and deionized water. Wipe slide thoroughly with paper towel. Follow this up with a cleaning using de-ionized water and paper towel drying completely. Place the first sample on top of the glass tile such that the normal actual width of the duster is positioned parallel to the length of the glass tile. The back of the sled should be position about 3.0 cm in front of the back edge of tile test surface. The sled and duster sample is lined up in the center of the path of the tile where the clamp on the sled lines up with the hook on the load cell. Then, press the "Zero" switch in order to zero the load cell.

6. Using the clamp attach the sled with the sample to the load cell. Press down gently on sample once to allow it to contact the surface.
7. Initiate test by depressing the "Test" switch. The load cell starts moving from the left to the right dragging the sled and the test sample. The distance traveled by sled as measured from the back edge of the sled in the starting position to front edge of the sled in the ending position is about 25 cm.
8. When the test is complete, the load cell stops and the device displays the measure of the Static Coefficient of Friction (ST) as well as the Kinetic Coefficient of Friction (KI). Record the measure of the Kinetic Coefficient of Friction for the dry sample.
9. Hit the "Return" switch such that the sled with the sample return to the starting position. Carefully unhook the sled plus the sample from the load cell. Re-clean glass tile surface with 20% IPA solution and buff dry with paper towel.
10. Carefully remove the test duster sample and weight it. Then re-attach onto the sled preparing it for wet friction testing. Using pump spray bottle or pipette, apply 0.8 mls of de-ionized water directly on the glass tile. The solution should be applied at the center of the area of the tile where the sled with the sample substrate are located at the start of the experiment directly (approximately 1 cm from the edge of the tile when measured from the left to the right and 4 cm from the back edge of the tile when measured forward). The cleaning solution should be applied on a circle or oval shape with an area of about 5-7 cm in width (the width being defined as the longitudinal dimension perpendicular to the direction of the sled) by 5-7 cm in length (the length being defined as the dimension parallel to the direction of the sled in motion). Position the sled with the test sample directly over the cleaning solution. Press down gently on sample once to allow it to absorb some of the solution and make contact with the surface. Then press the "Test" switch in order to initiate the test.
11. Again when the test is completed, the load cell stops and the device displays the measure of the Static friction and the Kinetic Coefficient of friction. Record the measure of the Static and Kinetic Coefficient of Friction for a "wet" sample.
12. Again hit the Return switch to send the sled back to the start position. Remove the test sample from the tile surface, and weigh it to determine amount of solution absorbed. Absorbency is determined by taking the amount of solution absorbed by the duster sample and dividing by the amount of solution applied to the surface and multiplying by 100.
13. Clean the test tile using a solution comprising 20% of Isopropyl Alcohol (hereinafter IPA), thoroughly wipe off any excess residue that may be left on the tile from the duster using paper towel. Repeat this procedure 3 times. Using de-ionized water do one final wipe of the top surface of the tile and buff this surface until it is dry.
14. Reposition the tile in the testing device. Take the sled and wipe it dry in order to remove any wetness from the previous test. Attach a second sample of duster.
15. Repeat steps 4 through 14 and record the results as data for the second repetition for the sample 1 duster.
18. Repeat steps 4 through 14 three more times for a total of 5 repetitions. Calculate and record the average of each result (i.e. "dry" and "wet" COF).
19. Take 5 samples of another duster type and repeat the entire procedure for each type of material.

Preparation of the Test Surface and Testing with Furniture Polish:

Test Surface—

The test surface is a smooth wood tile made of oak treated with polyurethane such as that used for wood floors (commercially available example is Bruce Hillden plank engineered flooring Gunstock Product code #E8311). The tile is 6.5 cm wide 30.5 cm long and 1 cm thick.

Test Solution—Pledge Natural Beauty Furniture Spray Aerosol (code A13114435)

Test Procedure—

1. Press the "Sled" button repeatedly until the sled weight displayed is 200 g (corresponding to the weight of sled used in the test)
2. Press the "Test Time" button repeatedly until 20 seconds is displayed for time.
3. Set the speed of the sled by pressing the "Test Speed" button at 1 cm/sec (in order to check press speed, press test, press return)
4. Using the "Return" switch, position the Load Cell to the starting point for test.
5. Clean the wood tile using a solution of Windex glass cleaner with paper towel in order to remove any greasy residue. Follow this with a cleaning using a solution comprising of 20% EPA and deionized water. Wipe slide thoroughly with paper towel. Follow this up with a further rinsing using de-ionized water and paper towel drying completely. Place the first sample on top of the wood tile such that the normal actual width of the duster is positioned parallel to the length of the glass tile. The back of the sled should be position about 3.0 cm in front of the back edge of tile test surface. The sled and duster sample is lined up in the center of the path of the tile where the clamp on the sled lines up with the hook on the load cell. Then, press the "Zero" switch in order to zero the load cell.
6. Using the clamp attach the sled with the sample to the load cell. Press down gently on sample once to allow it to contact the surface.
7. Initiate test by depressing the "Test" switch. The load cell starts moving from the left to the right dragging the sled and the test sample. The distance traveled by sled as measured from the back edge of the sled in the starting position to front edge of the sled in the ending position is about 25 cm.
8. When the test is complete, the load cell stops and the device displays the measure of the Static Coefficient of Friction (ST) as well as the Kinetic Coefficient of Friction (KI). Record the measure of the Kinetic Coefficient of Friction for the dry sample.
9. Hit the "Return" switch such that the sled with the sample return to the starting position. Carefully unhook the sled plus the sample from the load cell. Re-clean tile surface following procedure described above and buff dry with paper towel.
10. Carefully remove the test duster sample and weight it. Then re-attach onto the sled preparing it for wet friction testing. Take Pledge spray can and shake gently to mix solution. Then from about 2-3 inches away spray about 0.8 mls of product directly onto the wood tile. The furniture polish should be applied at the center of the area of the tile where the sled with the sample substrate are located at the start of the experiment directly (approximately 1 cm from the edge of the tile when measured from the left to the right and 4 cm from the back edge of the tile when measured forward). The furniture polish should be applied on a circle or oval shape with an area of about 5-7 cm in width (the width being defined as the longitudinal dimension perpendicular to the direction of the sled) by 5-7 cm in length (the length being defined as the dimension parallel to the direction of the sled in motion). Position the sled with the test sample directly over the furniture polish solution. Press down gently on sample once to allow it to absorb some of the solution and make contact with the surface. Then press the "Test" switch in order to initiate the test.

11. Again when the test is completed, the load cell stops and the device displays the measure of the Static friction and the Kinetic Coefficient of friction. Record the measure of the Static and Kinetic Coefficient of Friction for a "wet" sample.

12. Again hit the Return switch to send the sled back to the start position. Remove the test sample from the tile surface, and weigh it to determine amount of solution absorbed. Absorbency is determined by taking the amount of solution absorbed by the duster sample and dividing by the amount of solution applied to the surface and multiplying by 100.

13. Clean the test tile using a Windex solution and paper towel buffing vigorously to ensure all furniture polish is stripped off. Repeat 2 or 3 times. Follow this rinsing with solution comprising 20% of Isopropyl Alcohol (hereinafter IPA), thoroughly wipe off any excess residue that may be left on the tile from the Windex. Repeat this procedure 2-3 times. Using de-ionized water do one final wipe of the top surface of the tile and buff this surface until it is dry.

14. Reposition the tile in the testing device. Take the sled and wipe it dry in order to remove any wetness from the previous test. Attach a second sample of duster.

15. Repeat steps 4 through 14 and record the results as data for the second repetition for the sample 1 duster.

18. Repeat steps 4 through 14 three more times for a total of 5 repetitions. Calculate and record the average of each results (i.e. "dry" and "wet" COF).

19. Take 5 samples of another duster type and repeat the entire procedure for each type of material.

Various types of duster constructions (including the same design using different non-woven materials) are tested according to the above procedure. The degree to which materials tested are hydrophilic is expected to impact friction measurement. Additionally, friction is also anticipated to be affected by the three-dimensional topography of the different surfaces, with lower relief substrates yielding higher friction readings because of increased hydrogen bonding promoted by better substrate to surface contact when the substrate is less macroscopically three-dimensional. Since the degree of hydrophilicity of the various materials varies, friction is also expected it is possible to assess the impact or "behavior" of these materials on the ability of a cleaning pad to "glide" on a hard surface in both dry and wet environment. The different samples tested also vary from a surface characteristic standpoint. Some of these materials have a very smooth outer surface and make a lot of contact with the test surface while others comprise fibrous bundles which have more irregular surface contact. It is believed that a substrate material having a smooth outer surface results in higher friction due to the greater surface of the material being in contact with the hard surface.

Table 2 describes the dusters tested, including those pertaining to the invention as well as comparative dusters that lie outside the scope of the present invention.

TABLE 2

| | Product | Market | Fiber Bundles | Non-Wovens Attachment Side | Non-woven Cleaning Side | Absorbent Core |
|---|---|---|---|---|---|---|
| Comparative 1 | Pledge Duster Plus | US | 100% synthetic | 100% synthetic | None | None |
| Comparative 2 | | US/Europe | 100% synthetic | 100% synthetic | 1 layer 100% synthetic cut strips | None |
| Comparative 3 | Pledge | Europe | 100% synthetic | 100% synthetic | None | None |
| Comparative 4 | Evercare | US | 100% synthetic | 100% synthetic | None | None |
| Example 1 | Hydrophilic Duster | No | None | 100% synthetic | 8 layers Ahlstrom 28 gsm Cellulose laminated with 17 gsm Polypropylene | 200 gsm air-laid |
| Example 2 | Hydrophilic Duster | No | 100% synthetic | 100% synthetic | 2 layers Ahlstrom 28 gsm Cellulose laminated with 17 gsm Polypropylene | 135 gsm air-laid solid |
| Example 3 | Hydrophilic Duster | No | 100% synthetic | 100% synthetic | 2 layers Ahlstrom 28 gsm Cellulose laminated with 17 gsm Polypropylene | 90 gsm air-laid wide cut strips |
| Example 4 | Hydrophilic Duster | No | None | 100% synthetic | 8 layers 55 gsm - homogeneous 80% Polyester:20% Rayon | 200 gsm air-laid solid |
| Example 5 | Hydrophilic Duster | No | None | 100% synthetic | 8 layers 55 gsm - homogeneous 60% Polypropylene:40% Rayon | 200 gsm air-laid solid |
| Example 6 | Hydrophilic Duster | No | None | 100% synthetic | 8 layers 50 gsm - homogeneous 50% Polyester:50% Rayon 5 | 200 gsm air-laid solid |

TABLE 2-continued

| | Product | Market | Fiber Bundles | Non-Wovens Attachment Side | Non-woven Cleaning Side | Absorbent Core |
|---|---|---|---|---|---|---|
| Example 7 | Hydrophilic Duster | No | None | 100% synthetic | 8 layers 30 gsm - homogeneous 35% Polyester:65% Rayon | 200 gsm air-laid solid |
| Example 8 | Hydrophilic Duster | No | None | 100% synthetic | 8 layers 55 gsm - homogeneous latex bonded cellulose | 200 gsm air-laid solid |
| Example 9 | Hydrophobic Duster | No | None | 100% synthetic | 8 layers 55 gsm - homogeneous 100% Polypropylene | 200 gsm air-laid solid |

Results from COF testing dry and wet are shown in the chart shown in Table 3:

TABLE 3

| | Product | Dry Coefficient of Friction | | Wet Coefficient of Friction | | Absorbent Efficiency |
|---|---|---|---|---|---|---|
| | | Static | Kinetic | Static | Kinetic | |
| Comparative 1 | Pledge Duster Plus | 0.357 | 0.381 | 0.374 | 0.404 | 65% |
| Comparative 2 | Swiffer Duster | 0.649 | 0.65 | 0.571 | 0.609 | 65% |
| Comparative 3 | Pledge UK | 0.273 | 0.293 | 0.425 | 0.451 | 66% |
| Comparative 4 | Evercare | 0.593 | 0.585 | 0.578 | 0.594 | 69% |
| Example 1 | Hydrophilic Duster | 0.698 | 0.658 | 1.358 | 1.334 | 78% |
| Example 2 | Hydrophilic Duster | 0.806 | 0.771 | 1.432 | 0.83 | 82% |
| Example 3 | Hydrophilic Duster | 0.784 | 0.695 | 1.458 | 1.032 | 79% |
| Example 4 | Hydrophilic Duster | 0.756 | 0.825 | 0.808 | 0.874 | 45% |
| Example 5 | Hydrophilic Duster | 0.709 | 0.731 | 0.965 | 1.021 | 70% |
| Example 6 | Hydrophilic Duster | 0.791 | 0.875 | 1.086 | 1.156 | 76% |
| Example 7 | Hydrophilic Duster | 0.560 | 0.601 | 1.269 | 1.310 | 77% |
| Example 8 | Hydrophilic Duster | 0.812 | 0.822 | 1.336 | 1.426 | 78% |
| Example 9 | Hydrophobic Duster | 0.937 | 0.945 | 0.631 | 0.638 | 26% |

Data in Table 3 shows that current marketed dusters comparative 1, 2, 3, and 4 all have wet coefficient of friction readings below 0.65 for both static and importantly for kinetic (friction of sample being wiped across a surface). Also the absorbent efficiency of these dusters is also below about 70%. By comparison Examples 1 through 8 which all comprise non-wovens containing some amounts of hydrophilic fibers all have static and kinetic wet coefficient of friction measurements above 0.65. Most of the examples also have absorbent efficiencies of 70% or greater with the exception of Example 4. Example 4 is constructed using non-woven strips comprising of 80% polyester (PET) and 20% rayon. While the low percentage of rayon hydrophilic fibers aide in increasing friction, the absorbency of the material is limited due to the high percentage of synthetic polyester fibers. Example 9 is constructed with the outer strips made of 100% polypropylene. It too shows a static and kinetic coefficient of friction below 0.65 further supporting the benefit of having some level of hydrophilic fibers. In one embodiment, non-wovens according to the invention comprise at least about 20% hydrophilic fibers, in another embodiment at least about 25% hydrophilic fibers, in another embodiment at least about 30% hydrophilic fibers, in yet another embodiment at least about 35% hydrophilic fibers, and in yet another embodiment at least about 50% hydrophilic fibers. In one embodiment, duster non-wovens of the invention have a kinetic coefficient of friction of at least about 0.65, in another embodiment at least about 0.75, and in another embodiment at least about 0.9. In another embodiment the kinetic coefficient of friction is at least about 0.65, in another embodiment at least about 0.75, and in another embodiment at least about 0.9 and the absorbency is at least about 35%, in another embodiment at least about 45% and in another embodiment at least about 65%.

Results from COF testing dry and wet using Pledge Furniture polish are shown in Table 4:

TABLE 4

| | Product | Dry Coefficient of Friction | | Wet Coefficient of Friction | | Absorbent Efficiency |
|---|---|---|---|---|---|---|
| | | Static | Kinetic | Static | Kinetic | |
| Comparative 1 | Pledge Duster Plus | 0.243 | 0.238 | 0.495 | 0.344 | 68% |
| Comparative 2 | Swiffer Duster | 0.281 | 0.253 | 0.468 | 0.348 | 69% |

TABLE 4-continued

| | Product | Dry Coefficient of Friction | | Wet Coefficient of Friction | | Absorbent Efficiency |
|---|---|---|---|---|---|---|
| | | Static | Kinetic | Static | Kinetic | |
| Comparative 3 | Pledge UK | 0.234 | 0.225 | 0.426 | 0.333 | 64% |
| Comparative 4 | Evercare | 0.350 | 0.327 | 0.521 | 0.381 | 64% |
| Example 1 | Hydrophilic Duster | 0.347 | 0.359 | 0.902 | 0.656 | 77% |
| Example 2 | Hydrophilic Duster | 0.443 | 0.424 | 0.788 | 0.487 | 81% |
| Example 3 | Hydrophilic Duster | 0.431 | 0.382 | 0.802 | 0.568 | 81% |
| Example 4 | Hydrophilic Duster | 0.354 | 0.354 | 0.677 | 0.460 | 68% |
| Example 5 | Hydrophilic Duster | 0.528 | 0.486 | 0.725 | 0.571 | 78% |
| Example 6 | Hydrophilic Duster | 0.282 | 0.298 | 0.772 | 0.616 | 79% |
| Example 7 | Hydrophilic Duster | 0.372 | 0.389 | 0.801 | 0.645 | 79% |
| Example 8 | Hydrophilic Duster | 0.937 | 0.945 | 0.631 | 0.638 | 82% |
| Example 9 | Hydrophobic Duster | 0.374 | 0.384 | 0.510 | 0.395 | 46% |

Data in Table 4 compares the same dusters described in Table 2 for friction but uses a wood surface instead of a glass surface as is shown in Table 3. The testing also uses Pledge Furniture polish instead of de-ionized water. As such the co-efficient of friction numbers shown in Table 4 in general are lower than the co-efficient of friction numbers shown in Table 3. Nonetheless the trends are the same. Specifically, that current marketed dusters comparative 1, 2, 3, and 4 all have wet coefficient of friction measurements using Pledge furniture polish lower than those shown by dusters Examples 1 through 8. Example 9 is constructed with the outer strips made of 100% polypropylene. It too shows a static and kinetic coefficient of friction lower than data for Examples 1 through 8. This demonstrates the benefit of having some level of hydrophilic fibers even when testing with furniture polish. One embodiment has a kinetic coefficient of friction using Pledge furniture polish of at least about 0.4, in another embodiment at least about 0.475, and in another embodiment at least about 0.5.

Aqueous Cleaning Solution and Dispensing:

Cleaning and shine compositions can be delivered via a continuous flow delivery such as an aerosol or a vacuum sprayer or via a discontinuous flow such as that delivered via a trigger, pump sprayer and the like.

A measurement of output from a continuous delivery system is determined by 1) Priming the sprayer, 2) Pre-weigh the bottle 3) Depress delivery mechanism for 10 seconds, 4) Re-weigh bottle, and 5) Determine difference of pre and post. The number is then divided by 10 to determine the amount of delivery per second.

A measurement of output from a discontinuous delivery system is determined by 1) Priming the sprayer, 2) Pre-weigh the bottle 3) Depress delivery mechanism 10 times, 4) Re-weigh bottle, and 5) Determine difference of pre and post. The number is then divided by 10 to determine the amount of delivery per spray accentuation.

A simple evaluation of the Pledge Duster Plus solution was conducted. One spray of product was applied to a glass mirror surface and wiped to dryness with a paper towel folded to quarter its size. The same procedure was repeated on a wood surface. The results were visually evaluated. On the glass surface the Pledge Duster Plus solution left a noticeable white, hazy appearance. On the wood surface the Pledge Duster Plus solution left a slightly shiny appearance. While not wishing to be limited by theory, the results support the analytical data that suggests the Pledge Duster Plus composition is designed to be more appropriate for use on wood, particularly if used at higher levels. If used on glass and shiny surfaces the amount of solution needs to be used sparingly or directly on the duster to limit residue. This is also consistent with the instructions provided by the manufacturer for how to best use the product.

While the Pledge Duster Plus solution appears to be more suitable for use on wood, wood/laminate and other like surfaces, using it with the Pledge Duster Plus duster can lead to a splotchy or uneven shine. As discussed above this is due the synthetic and fibrous construction of the duster. Given this observation it is hypothesized that even formulations with higher levels of oils and shine enhancing ingredients such as Pledge furniture polish could show a similar splotchy and uneven shine affect if used in combination with a duster composed essentially of synthetic polymers.

It is recognized and further hypothesized that formulations designed for enhancing gloss or shine can achieve a more consistent visual end result when used with hydrophilic dusters such as those discussed in the descriptions in this invention. Typically formulations which achieve enhanced gloss or shine require % solids levels at least about 0.5%, in another embodiment at least about 1%, in another embodiment at least about 2%, in another embodiment at least about 5% solids.

Technical Performance Comparison:

To demonstrate the benefits of a cleaning, dusting and shine enhancing solution used in combination with an optimized wet duster design a series of technical performance tests were conducted. The performance tests were conducted on a wood surface as this represents a typical surface where enhanced gloss or shine is desired. A range of different solutions are tested using several different types of dusters including a duster comprising of 100% synthetic fibers and a duster comprising of over 50% hydrophilic fibers.

Test Surface 22 inch by 36 inch area of smooth oak rectangular coffee table (SKU #3902P made by Riverside Furniture Corp, 6815 Jenny Lind Rd., Ft. Smith, Ariz., 72903)

Test Method—

Before conducting any tests the test surface is cleaned using Windex plus paper towels, then rinsed with 20% IPA solution, followed by final rinse and dry with de-ionized water and paper towel. Testing is conducted in a constant humidity and temperature environment of 50% Relative Humidity and 72° F.

Figure 16:
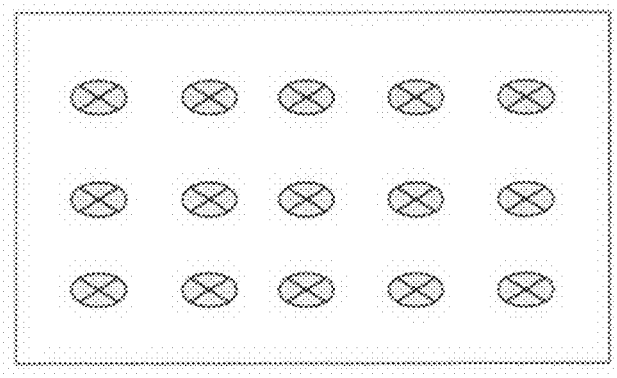
FIG. 16 illustrates 15 spots disposed on a surface in a 3×5 grid.

1. The test surface is measured for initial gloss using a calibrated gloss meter (BYK Gardner S-No. 765001, Cat No 4520)

at 60 degree position on 15 different spots evenly spread out across surface as per FIG. 16. Record the average gloss and standard deviation for the untreated surface. The ideal test surface has an initial gloss measurement between about 30 and 50 when tested at 60 degree position. Since real wood surfaces can have irregularities in color which impacts gloss, care needs to be taken to do measurements at exactly same spots for each test. Different surfaces should also be screened to find a surface with reasonable consistency in gloss across the surface.

Figure 17:
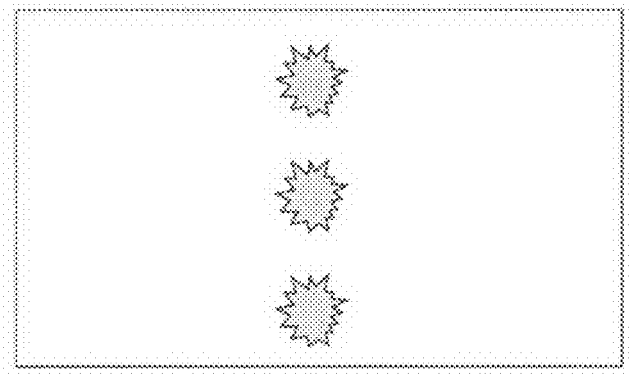
FIG. 17 illustrates three sprays applied directly to a test surface.
Figure 18:
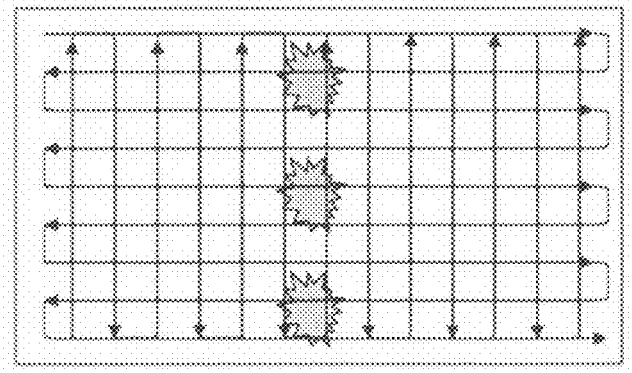
FIG. 18 illustrates a pattern for moving a duster to wipe the test surface.

2. Attach appropriate test duster to appropriate duster handle and shake duster to fluff.
3. Apply about 1 ml of cleaning solution evenly across the face of a duster. This typically is achieved with 2 to 4 sprays depending on the output of the sprayer. Testing below used 0.5 ml output pump sprayer with aqueous solutions and aerosol for furniture polish emulsion.
4. Then immediately apply 3 sprays directly to the test surface as per FIG. 17. Each spray should be about 7-10 cm in diameter and total liquid applied to surface about 1.5 mls. With aerosol holding button for 1 second delivers about 0.5 mls.
5. Wipe surface with duster starting from upper left corner and moving to the far right corner. Then reverse direction wiping side to side for about 9 to 10 swipes. Then move duster to the far left bottom corner and move to the upper left top corner. Reverse wiping direction and continue in up and down motion for about 12 swipes. Use FIG. 18 for guidance. Once surface has been wiped, start a timer. Allow surface to completely dry and record amount of time required for complete drying to occur.
6. Once surface is dry, grade surface for evenness of shine using a 0 to 4 scale where 0 is very even shine, 1 even shine with slight splotches or streaks, 2 is uneven shine with moderate splotches or streaks, 3 is uneven shine with noticeable splotches or streaks and 4 is uneven shine with very noticeable splotches or streaks. After visual grading the surface is re-measured using the same gloss meter at the exact same points where measurements were taken for initial gloss.
7. At least 4 replicates for each condition should be conducted. The data from each of the replicates is averaged. Data is reported as Visual Evenness of Shine Grade, Drying Time, and Change in Gloss.

Products Tested

Solutions
Cleaning and Shine Composition—Example 1
Non-ionic surfactant 1—0.45%
Non-ionic co-surfactant 2—0.025%
Amphoteric co-surfactant 3—0.025
Ethanol solvent—3%
Water soluble Shine polymer—1%
Dow Corning AF suds suppressor—0.003%
Preservative—0.005%
Perfume—0.1%
% solids—1.5

Wet Duster Using Hydrophilic Non-Wovens—Example 1
Attachment layers used to form pocket for holding handle—1 layer 30 gsm synthetic bicomponent thru-air+1 layer 20 gsm synthetic bicomponent spun-bond
Absorbent core—200 gsm air-laid core 55 mm wide by 150 mm long
Hydrophilic Non-wovens—10 layers of Ahlstrom material 45 gsm comprising 28 gsm cellulose tissue and 17 gsm spun-bond polypropylene laminate cut into strips 6 mm wide forming 26 strips per layer, 6 layers bonded using single seal and 4 layers bonded using dual seal.

Tow fibers—None present

Comparative Solution 1
Pledge Natural Beauty Furniture Polish sold as 12.5 ounce aerosol can Comparative Solution 2
Pledge Duster Plus clean and dust solution sold as part of a kit in 0.8 ounce bottle Comparative Duster 1
Pledge Duster Plus duster composed of 3 layers of 20 gsm synthetic bicomponent spun-bond layers to form attachment+ about 10 g of 50:50 polyethelene: polyester bicomponent tow fibers used in the form of fiber bundles. No other non-wovens are present on cleaning side.

Results from Testing are shown in following Tables 5, 6 and 7:

TABLE 5

Average Drying Time in Minutes

| | Example 1 Duster (Hydrophilic Duster) A | Comparative 1 Duster (Pledge Duster Plus) B | Delta Drying Factor B – A |
|---|---|---|---|
| Example 1 Solution | 1.5 minutes | 8.1 minutes | 5.4 X |
| Comparative 1 Solution (Pledge Furniture Polish) | 0.2 minutes | 4.9 minutes | 24.5 X |
| Comparative 2 Solution (Pledge Duster Plus solution) | 0.7 minutes | 5.2 minutes | 7.4 X |

TABLE 6

Average Evenness of Visual Shine Grade

| 0 to 4 - where 0 is most even and 4 is most uneven | Example 1 Duster (Hydrophilic Duster) A | Comparative 1 Duster (Pledge Duster Plus) B | Delta in Grades B – A |
|---|---|---|---|
| Example 1 Solution | 1.1 | 2.8 | +1.7 |
| Comparative 1 Solution (Pledge Furniture Polish) | 1.2 | 3.2 | +2 |
| Comparative 2 Solution (Pledge Duster Plus solution) | 0.5 | 2.0 | +1.5 |

TABLE 7

Average Change in Shine Treated versus Untreated

| Gloss Measurement Change at 60 degrees (higher the number the greater the change) | Example 1 Duster (Hydrophilic Duster) A | Comparative 1 Duster (Pledge Duster Plus) B | Delta in Gloss Change B – A |
|---|---|---|---|
| Example 1 Solution | | | |
| Ave Change in Shine - Gloss Units | +4.7 | +5.3 | +0.6 |
| Ave Change in Standard Deviation - Gloss Units | +0.3 | +1.9 | +1.6 |
| Comparative 1 Solution | | | |

TABLE 7-continued

| Average Change in Shine Treated versus Untreated | | | |
|---|---|---|---|
| Gloss Measurement Change at 60 degrees (higher the number the greater the change) | Example 1 Duster (Hydrophilic Duster) A | Comparative 1 Duster (Pledge Duster Plus) B | Delta in Gloss Change B – A |
| (Pledge Furniture Polish) | | | |
| Ave Change in Shine - Gloss Units | +2.4 | +1.4 | −1 |
| Ave Change in Standard Deviation - Gloss Units | +0.4 | +1.2 | +0.8 |
| Comparative 2 Solution (Pledge Duster Plus solution) | | | |
| Ave Change in Shine - Gloss Units | +0.7 | +0.3 | −0.4 |
| Ave Change in Standard Deviation - Gloss Units | −0.8 | +0.4 | +1.2 |

Key Conclusions From Results shown in Tables 5, 6 and 7:

1. Table 5 shows the drying time when using the hydrophilic duster Example 1 is anywhere from 5 to 25× faster when compared to the Comparative Duster 1 which is the synthetic Pledge Duster Plus duster. Rapid drying time on wood surfaces is very important for not only convenience but for reducing surface damage. With the Pledge Furniture polish (comparative Solution 1) this is particularly important given the high hydrocarbon solvent present in the formula which can impact the urethane finish if it sits too long on the surface.
2. Table 6 shows the "visual shine end result" when testing any of the solutions is much more consistent when using the hydrophilic duster Example 1 versus using the Comparative Duster 1 which is the synthetic Pledge Duster Plus duster.
3. The higher consistency in shine reported as visual grades in Table 6 is also shown by gloss measurements shown in Table 7. This is shown by the average change in the standard deviation for gloss measurements taken before and after treatment. The results when using the hydrophilic duster Example 1 are anywhere from about 1 to 1.5 units lower in standard deviation compared to results when using the Comparative Duster 1 which is the Pledge Duster Plus duster. For 2 of the 3 chemistries tested, the actual average shine is also higher when testing is conducted using the hydrophilic duster. Testing with Example 1 solution and Comparative Duster 1 shows higher average change in shine but also higher standard deviation. This suggests that the contrast in shiny versus non-shiny areas is more magnified. This is likely due to the overall gloss enhancement for Example 1 solution is greater when compared to the other solutions.

Overall the hydrophilic duster provides faster drying and a more consistent shine enhancement when used with chemistries with shine enhancing ingredients including polymers, oils and the like.

Dusting & Cleaning Compositions:

Solutions to use for multi-surface dusting and cleaning on a wide range of surfaces from wood to electronics to glass have a low level of non-volatile cleaning agents as measured using a % solids analysis as described above. The amount % solids is less that about 1.0%, in another embodiment at most about 0.75%, in another embodiment at most about 0.5% and in another embodiment at most about 0.3%. On the other hand a cleaning, dusting and gloss enhancement solution useful for hard surfaces such as wood, wood laminates, granite, and plastics to soft surfaces including leather, and upholstery typically has a higher level of non-volatile cleaning agents as measured by % solids. The amount of % solids is in one embodiment at least about 0.5%, in another embodiment from about 0.75% to about 10%, in another embodiment from about 1% to about 5%.

An optimum cleaning, dusting and gloss enhancement solution can be formulated as an isotropic aqueous composition or as an emulsion which contains an aqueous media and a significant level of oil. As used herein, the term isotropic refers to solutions which are clear in the absence of perfume components. Perfume components at sufficiently high levels can render the compositions hazy or even cloudy. In isotropic solutions, the level of oil, excluding perfume components, is at most about 0.25%. Emulsions herein are oil-in-water emulsions that are typically milky in color and have an increased oil content, at least 0.25% excluding perfume components.

Isotropic Aqueous Compositions:

Isotropic aqueous chemistry is beneficial in that it can be used for wide range of tasks and applied to a wide range of surfaces from hard to soft. The chemistry depends on the specific cleaning task. For example if good cleaning with low film/streaking is required such as for glass surfaces the composition typically uses low residue surfactants at low levels. If greater cleaning is required and film/streaking is not as noticeable, higher levels and different types of surfactants are used. If shine enhancement is required, water soluble polymers are added.

Exemplary water soluble polymers for gloss (shine) enhancement are those derived polyacrylate and polymethacrylate polymers and co-polymers, as well as polyvinyl pyrrolidone polymers and copolymers. For example, U.S. Pat. No. 4,869,934 discloses floor polishing and coating compositions consisting essentially of 1% to 13% styrene-acrylic copolymer with a weight ratio of monomers from about 2:1 to about 3:1, a second copolymer consisting of interpolymerized (meth)acrylate-(meth)alkyl acrylate groups, fugitive and permanent plasticizers, ammonia and other minors. Other exemplary polymers for the duster compositions of the invention are compositions that are strippable. WO 95/00611 discloses a cleaning composition for hardwood floors comprising an alkyl pyrrolidone surfactant and a of vinyl pyrrolidone shine copolymer.

One embodiment for a highly aqueous gloss enhancing solution is described in patent # US20050096239A1, filed Oct. 5, 2004, Barnabas et al. The application describes specific polymers, styrene-acrylic copolymers which provide gloss enhancement on wood surfaces. The ratio of styrene to acrylic is from about 2:1 to about 1:2. Stripability can be fine-tuned of the copolymers can be fine-tuned via changes in molecular weight of the polymers and changes in the level of polymer incorporated into the aqueous composition. When used in combination with hydrophilic dusters of the invention, it was found that the formulations described herein are beneficial for use on many non-floor surfaces including wood and wood laminate furniture, plastic and metal furniture and the like. In one embodiment, levels of polymer for use with the aqueous compositions and hydrophilic dusters of the present invention are from about 0.5% to about 10%, in another embodiment from about 0.75% to about 5%, in another embodiment from about 0.75% to about 4% by weight of the aqueous composition.

Compositions of Aqueous and Oil Emulsions:

Since wood is a natural material, it is vulnerable to the effects of aging including becoming dried out, cracked or stained. Emulsions comprising water and oil can be beneficial for wood adding benefits such as nourishing and protection going beyond cleaning, dusting and gloss enhancement. Furniture polishes typically formulated as emulsions are well known in the art. Typical furniture polishes have ingredients including A) polishing agents including waxes, polymers and oils, B) solvents particularly hydrocarbon solvents necessary for dissolving and softening water insoluble materials used in the polish to minimize build-up , C) emulsifiers/surfactants for bridging water and oil into uniform emulsions, D) optional propellants to make polish easier to dispense as an aerosol and E) optional other ingredients including preservatives, colorants, fragrance, corrosion inhibitors and polishing abrasives.

Exemplary embodiments for emulsions useful with a hydrophilic duster are described in the art and referenced herein including U.S. Pat. No. 4,810,407, dated Mar. 7, 1989, Paul E. Sandvick; U.S. Pat. No. 5,112,394, dated May 12, 1992, Eric J. Miller; U.S. Pat. No. 5,085,695, dated Feb. 4, 1992, Randen et al; U.S. Pat. No. 5,397,384 Mar. 14, 1995, Karen Wisniewski; U.S. Pat. No. 6,930,080B2, dated Aug. 16, 2005 Moodycliffe et al; U.S. Pat. No. 6,652,632B2, dated Nov. 25, 2003 Moodycliffe et al. Exemplary emulsions have silicone at least 0.25% by weight of the emulsion, more in another embodiment at least about 0.5% and in another embodiment at least about 1%.

Aqueous Solution Components:

In addition to the polymers for gloss enhancement benefits, the compositions optionally comprise surfactants, hydrophilic polymers, organic cleaning solvent, suds suppressor, perfume and other adjuvants. Exemplary aqueous solution components are found in U.S. Ser. No. 11/500,233 by Sherry and Policicchio filed on Aug. 7, 2006, assigned to The Procter & Gamble Company.

System Designs Including Marketable Starter Kits and Refills:

Single Duster Starter Kits and Refills

In one embodiment, the invention relates to a starter kit comprising a handle suited to for the duster and given amount of dusters (1-10) wherein each duster comprises hydrophilic non-woven layers, bundle fibers and a core located in close proximity to the duster handle wiping portion; the Starter Kit also comprises a separate container housing aqueous cleaning solution, said container being optionally releasably attachable to the duster handle; the solution container, in one embodiment, includes a means for dosing an the aqueous cleaning solution. The attachment portion of the duster handle, in one embodiment forms an angle of 70° to 160° with respect to the base of the wiping portion of the handle; the fiber bundles are polyester 'tow' fibers and the hydrophilic non-woven layers comprise about 25% or more cellulose fibers and are cut into a plurality of strips. The duster core is in one embodiment uncut. Exemplary arrangements of the hydrophilic non-woven layers, bundle fibers and core with respect to each other are described in Designs 1-5. In another embodiment, the Starter Kit dusters lack bundle fibers; the duster architecture is then similar to that described in Design 6. The starter kits described above are marketed and sold along with system refills. In one embodiment, a solution refill container comprising solution is provided such that the refill container houses a larger volume of cleaning, dusting or polishing solution than that provided in the starter kit. The refill container is not equipped with a spraying mechanism. Instead, consumers are instructed, using pictures and/or words, to dispense some of the contents of the refill container into the spray bottle container provided in the Starter Kit. Optionally, a refill for dusters is also provided wherein the number of dusters in the refill system is larger than that provided in the Starter Kit. The refill package for the dusters optionally includes one or more handles. In further embodiments the dusters described in the invention are be sold as stand alone items without any solution and the solution is sold as stand alone without any dusters.

Wet dusters and associated aqueous chemistry sprays are provided with instructions for use. For best results, fiber bundle layers, if present, are first used for dry dusting. The accumulated dust on the bundle fibers is then emptied, optionally by shaking the duster, into a disposal area prior to wet dusting and cleaning. This minimizes potential contamination of the hydrophilic non-woven layers. For wet dusting, the duster is sprayed one to five times with aqueous chemistry solution sufficient to dampen it. The number of sprays depends on the actuation spray volume and the amount of surface to be dusted; continued dampening of the duster is done as needed. For wet cleaning or polishing, spray the surface directly. For polishing surfaces, the user is instructed to start with a clean duster. Then after spraying wipe the surface to dryness; optionally additional wiping once the surface is dry to help buff off an excess polish. Once surfaces are cleaned or polished the same used duster can continue to be used for dusting. Optionally, further instructions and advertising are provided explaining that the spray solution can be used with other duster systems and that the duster can be used in combination with alternative cleaning, dusting and polishing solutions.

Two Duster Starter Kits and Refills

Optionally, one or more kits are sold and marketed for separate dry and wet dusters. This provides optimum dry and wet dusting/polishing as the benefits of performance boosting tacky and hydrophobic coatings on fiber bundles using combined wet/dry dusters is limited because by the detrimental effects aqueous solutions have on the coatings present on the dry dusters. Use of a separate dry duster maximizes the flexibility for increasing the fiber bundle content of the duster and associated coating. Thus, in one embodiment, two separate dusters, one specially designed for dry dusting and the second one specially designed for wet dusting, are sold on marketed. An exemplary dry duster is already marketed under the Swiffer brand. In one embodiment a wet duster is composed of a plurality of hydrophilic non-woven strips in combination with an absorbent core and exclude tow fibers. An example of this design is shown in FIG. 6. The dry and wet dusters can be combined in a single Starter Kit, bundled together or sold in separate Starter Kits and advertised together for optimum dusting performance. In another embodiment the starter kit of the wet duster can have an additional removable adapter such as the one shown in FIG. 3. Instructions for use explain that the wet side should be used with the cleaning solution while the dry side should be kept dry for optimum performance. Instructions in one embodiment explain that one of either the dry or the wet dusters is discarded, while the other is re-used if it still appears to have mileage or capacity left to dust or clean. This is one of the advantages of the two duster system.

All-In-One Duster Starter Kit and Refills:

An alternative embodiment for providing optimum dry and wet dusting is an all-one duster such as the one shown as Design 9 in FIG. 13. Starter kits and refills are similar to those described above in section for "Single Duster Starter Kits and refills". The important difference is the instructions for use explain that as the wet side gets overly saturated the entire duster should be replaced as the dry side needs to stay dry for optimum performance. If perforations are added whereby the dry and/or the wet portions are strippable from each other, the instructions are modified more in line with those used for the "Two Duster Starter Kits and Refills system".

Pre-Moistened Duster Starter Kit and Refills:

Optionally kits and refills can be sold where the dusters are pre-moistened. In this embodiment the moistened dusters can be contained within a reseal able pouch, canister or tub. Starter kits are sold where the packaged pre-moistened dusters are placed into a carton along with a handle. In one embodiment, dry dusters are added to the starter kit to provide dry and wet dusting. Optionally, a handle can simply be bundled with the pre-moistened The dusters described in this patent are, in one embodiment, used in conjunction with a container that enables dosing. The dosing mechanism can be any known in the art. The dosing mechanism is accomplished by a sprayer. Non-limiting examples of spraying mechanisms for use herein include pump sprayers, trigger sprayers and aerosols.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A kit comprising a duster pad having a longitudinal axis and a cleaning composition said duster pad comprising two sides, a first side and a second side opposed thereto and:

wherein said first side comprises tow fibers, and said second side comprises at least one layer comprising a hydrophilic non-woven capable of contacting a surface to be cleaned and having strips extending outwardly in both directions from said longitudinal axis and at least one non-woven layer capable of being attached to a handle, whereby said duster pad can be used with either said first side or said second side contacting a surface without removing said duster from the handle, and wherein said cleaning composition comprises a solids content at least about 0.5% by weight of the cleaning composition and is disposed in a spray bottle.

2. The kit in claim 1, wherein the at least one layer comprises at least about 20% hydrophilic fibers.

3. The kit of claim 1 further comprising at least one fiber bundle layer.

4. The kit of claim 1 further comprising at least one absorbent core.

5. The kit of claim 3 further comprising at least one absorbent core.

6. The duster pad of claim 1 wherein the first side further comprises at least one hydrophilic non-woven layer having a plurality of said strips extending laterally outwardly from said longitudinal axis.

7. The kit of claim 1 further comprising a non-woven layer.

8. The kit of claim 1 wherein the at least one hydrophilic non-woven is bonded using a single seal, said single seal being continuous or discontinuous along the length of the longitudinal axis.

9. The kit of claim 8 wherein the at least one hydrophilic non-woven is further bonded using one or more sets of staggered continuous or discontinuous double seals.

10. The kit of claim 1 wherein the at least one hydrophilic non-woven comprises a laminate.

11. The kit of claim 1 wherein the at least one hydrophilic non-woven comprises a bi-laminate.

12. The kit of claim 1 comprising a ratio of fluffed thickness to flat thickness from about 3 to 1 to about 100 to 1.

13. The kit of claim 12 comprising a ratio of fluffed thickness to flat thickness from about 2 to 1 to about 50 to 1.

14. The kit of claim 1 further comprising one or more stiffening layers.

15. The kit of claim 6, wherein the plurality of strips form at least one loop.

16. The kit of claim 1, further comprising at least one scrubbing zone.

17. The kit of claim 1 comprising from 2 to 20 hydrophilic non-woven layers.

18. The kit of claim 1 comprising from 3 to 15 hydrophilic non-woven layers.

19. The kit of claim 1 wherein the basis weight of at least one hydrophilic non-woven layer is from about 10 $g/m^2$ to about 125 $g/m^2$.

20. The kit of claim 1 wherein the at least one hydrophilic non-woven layer has an absorbency of from about 2 $g/m^2$ to about 10 $g/m^2$.

21. The kit of claim 1 wherein the at least one hydrophilic non-woven layer has an absorbency of from about 2 $g/m^2$ to about 7 $g/m^2$.

22. The kit of claim 4 wherein the basis weight of the at least one absorbent core is from about 75 $g/m^2$ to about 300 $g/m^2$.

23. The kit of claim 4 wherein the absorbent core has an absorbency of from about 7 grams per gram non-woven to about 20 gram per gram non-woven.

24. The kit of claim 23 wherein the cleaning solution has solids content at least about 1% by weight of the cleaning solution.

25. The kit of claim 24 wherein the cleaning solution has a solids content of at least about 5% by weight of the cleaning solution.

26. The kit of claim 25 wherein the cleaning solution has a solids content of at least about 10% by weight of the cleaning solution.

27. The kit of claim 1 wherein the cleaning solution comprises an oil-in-water emulsion.

28. The kit of claim 1 wherein the cleaning solution comprises at least one shine enhancement agent.

29. The kit of claim 28 wherein the shine enhancement agent comprises acrylate and methacrylate polymers and copolymers, silicone polymers and copolymers and vinyl pyrrolidone polymers and copolymers, and mixtures thereof.

30. The kit of claim 1 wherein the duster pad is pre-moistened.

31. The kit of claim 30 wherein the cleaning solution comprises a solids content at least about 1% by weight of the cleaning composition.

32. The kit of claim 1 wherein the duster pad has a load factor of from about 1.5 to about 7.

33. A duster comprising a) optionally, a handle, said handle optionally comprising a swivel joint b) an adapter operatively attached to the handle c) the duster pad of claim 1, operatively attached to the adapter d) a cleaning composition comprises a solids content of at least about 1% by weight of the cleaning composition.

34. A duster pad for two sided use comprising:

a) at least one hydrophilic non-woven layer located on a first side of the cleaning substrate b) at least one layer of fiber bundles located on a second side opposite the first side c) at least one non-woven layer between the at least one hydrophilic non-woven layer and the at least one layer of fiber bundles d) a cleaning composition on at least one of a first side and/or a second side comprising a solids content of at least about 1% by weight of the cleaning composition, and e) an elongate handle removably attached to said duster pad, said handle being angled to allow a user to rotate the duster about said handle from said first side to said second side, so that either side may contact a surface to be cleaned without removal of said duster pad from said handle.

* * * * *